US010962900B2

(12) United States Patent
Matsuzaki et al.

(10) Patent No.: US 10,962,900 B2
(45) Date of Patent: Mar. 30, 2021

(54) SEAL MEMBER, UNIT, AND IMAGE FORMING APPARATUS

(71) Applicant: CANON KABUSHIKI KAISHA, Tokyo (JP)

(72) Inventors: Hiroomi Matsuzaki, Mishima (JP); Kazuki Matsumoto, Fuji (JP); Hiraku Sasaki, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 270 days.

(21) Appl. No.: 15/573,941

(22) PCT Filed: Jun. 27, 2016

(86) PCT No.: PCT/JP2016/003090
§ 371 (c)(1),
(2) Date: Nov. 14, 2017

(87) PCT Pub. No.: WO2017/002355
PCT Pub. Date: Jan. 5, 2017

(65) Prior Publication Data

US 2018/0292769 A1 Oct. 11, 2018

(30) Foreign Application Priority Data

Jun. 30, 2015 (JP) ..... 2015-132126

(51) Int. Cl.
*G03G 15/08* (2006.01)
*G03G 21/00* (2006.01)

(52) U.S. Cl.
CPC ..... *G03G 15/0817* (2013.01); *G03G 15/0812* (2013.01); *G03G 21/0011* (2013.01)

(58) Field of Classification Search
CPC ..... G03G 15/0812; G03G 15/0817; G03G 21/0011
See application file for complete search history.

(56) References Cited

U.S. PATENT DOCUMENTS 5,475,467 A 12/1995 Watanabe et al.
5,701,558 A 12/1997 Kojima
(Continued)

FOREIGN PATENT DOCUMENTS

CN 1201171 A 12/1998
CN 1575441 A 2/2005
(Continued)

OTHER PUBLICATIONS

Notification of Transmittal of the International Search Report and the Written Opinion dated Sep. 13, 2016, in International Application No. PCT/JP2016/003090.
(Continued)

*Primary Examiner* — Walter L Lindsay, Jr.
*Assistant Examiner* — Geoffrey T Evans
(74) *Attorney, Agent, or Firm* — Venable LLP

(57) ABSTRACT

A seal member includes a first seal portion abutting an end portion of a rotating body to seal a gap between a storage container and the end portion, and a second seal portion abutting an end portion of a blade to seal a gap between the storage container and the end portion. The second seal portion has a tip contacting portion to contact a tip portion of the blade and a non-tip contacting portion to contact a portion of the blade except for the tip portion. The non-tip contacting portion is recessed to form a step between the non-tip contacting portion and the tip contacting portion. The tip contacting portion includes a base portion to contact with the storage container, an abutting portion configured to abut the blade, and a connecting portion which connects the base portion and the abutting portion to each other.

18 Claims, 22 Drawing Sheets

(56) References Cited

U.S. PATENT DOCUMENTS

| | | | | |
|---|---|---|---|---|
| 6,094,550 | A | 7/2000 | Kido et al. | |
| 6,208,817 | B1 | 3/2001 | Chadani et al. | |
| 6,341,206 | B1 | 1/2002 | Yamaguchi et al. | |
| 6,487,383 | B2 | 11/2002 | Buchanan et al. | |
| 6,553,195 | B2 | 4/2003 | Korfhage et al. | |
| 7,177,565 | B1 | 2/2007 | Miller | |
| 8,116,657 | B2 | 2/2012 | Kant et al. | |
| 8,301,056 | B2 | 10/2012 | Matsushita et al. | |
| 8,478,158 | B2 | 7/2013 | Matsushita et al. | |
| 8,521,057 | B2 | 8/2013 | Matsushita et al. | |
| 8,644,725 | B2 | 2/2014 | Brown et al. | |
| 8,824,918 | B2 | 9/2014 | Kashiide et al. | |
| 9,213,263 | B2 | 12/2015 | Matsuzaki et al. | |
| 9,268,261 | B2 | 2/2016 | Handa et al. | |
| 9,304,444 | B2 | 4/2016 | Shimizu et al. | |
| 9,625,852 | B2 | 4/2017 | Shimizu et al. | |
| 2005/0063729 | A1* | 3/2005 | Okamoto ..... | G03G 15/0817 399/103 |

FOREIGN PATENT DOCUMENTS

| | | | |
|---|---|---|---|
| CN | 102749824 | A | 10/2012 |
| CN | 203705825 | U | 7/2014 |
| JP | S61-185770 | S | 8/1986 |
| JP | H05-2322 | A | 1/1993 |
| JP | H05-002322 | A | 1/1993 |
| JP | H06-308819 | A | 11/1994 |
| JP | H07-13390 | A | 1/1995 |
| JP | 2000-352874 | A | 12/2000 |
| JP | 2000-352875 | A | 12/2000 |
| JP | 2010-091954 | A | 4/2010 |
| JP | 2010-191338 | A | 9/2010 |
| JP | 2013-015706 | A | 1/2013 |
| JP | 2014-081620 | A | 5/2014 |

OTHER PUBLICATIONS

Japanese Office Action dated Apr. 2, 2019, in related Japanese Patent Application No. 2015-132126.

Chinese Office Action dated Dec. 31, 2019, in related Chinese Patent Application No. 201680037450.5 (with English translation).

* cited by examiner

[Fig. 6]
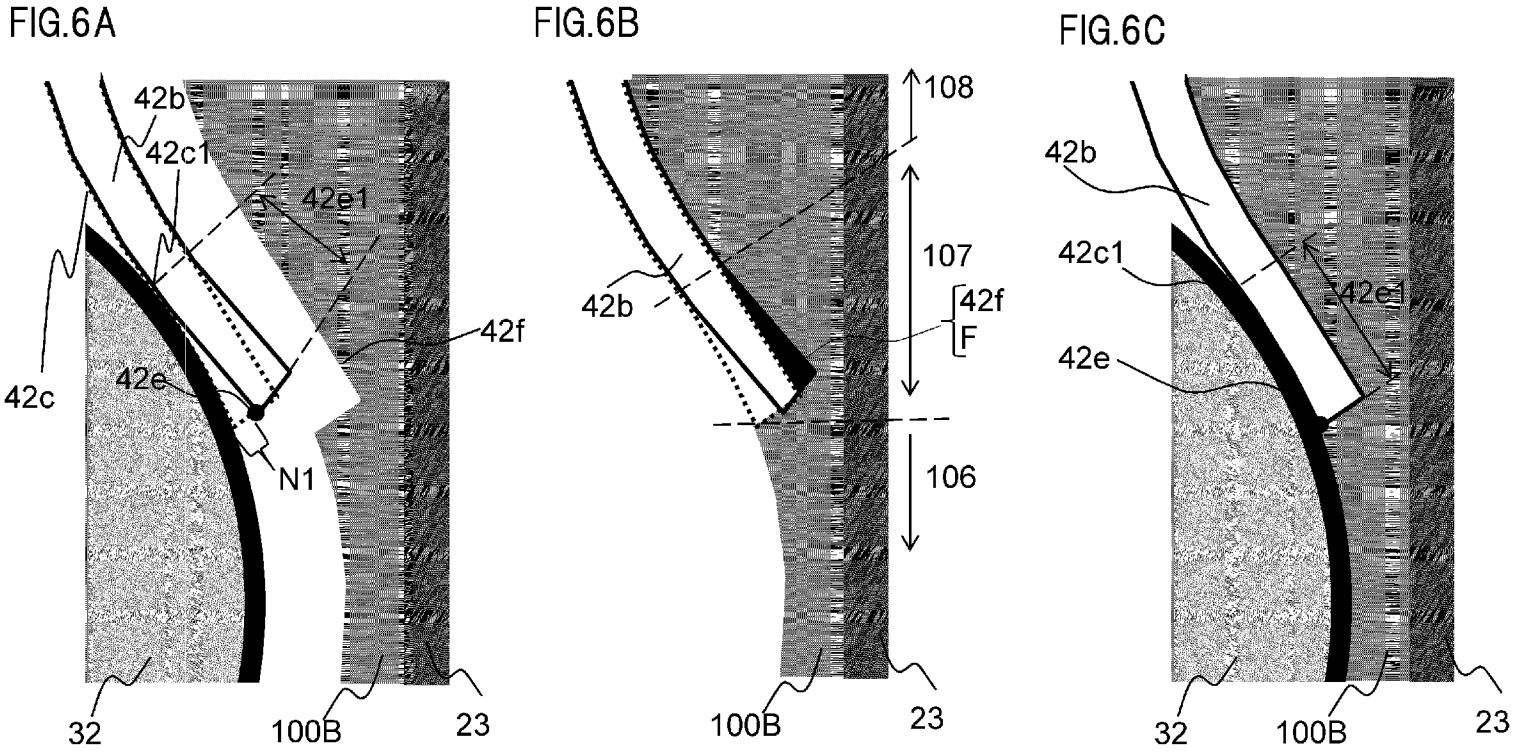

[Fig. 7]
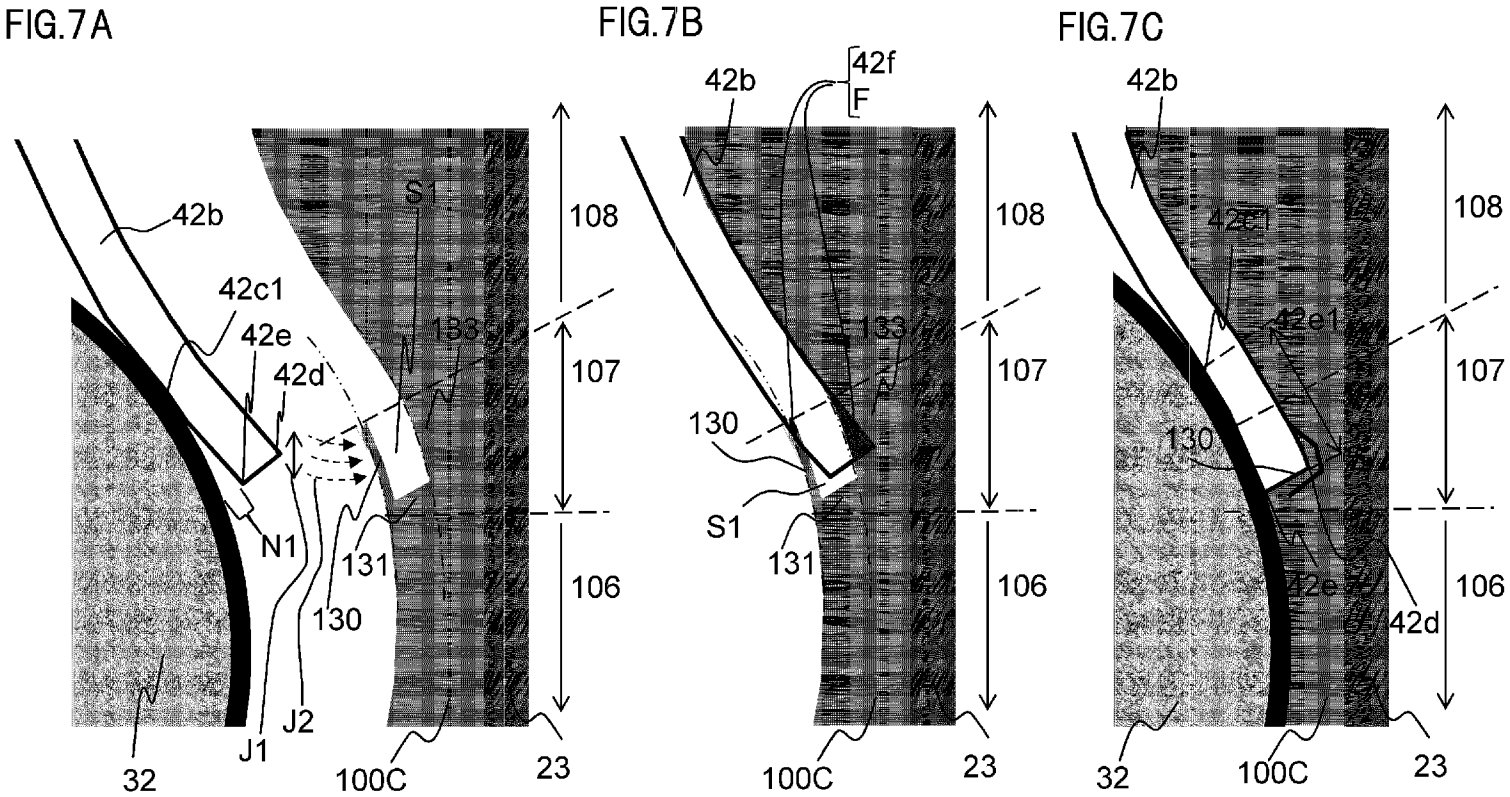

[Fig. 8]
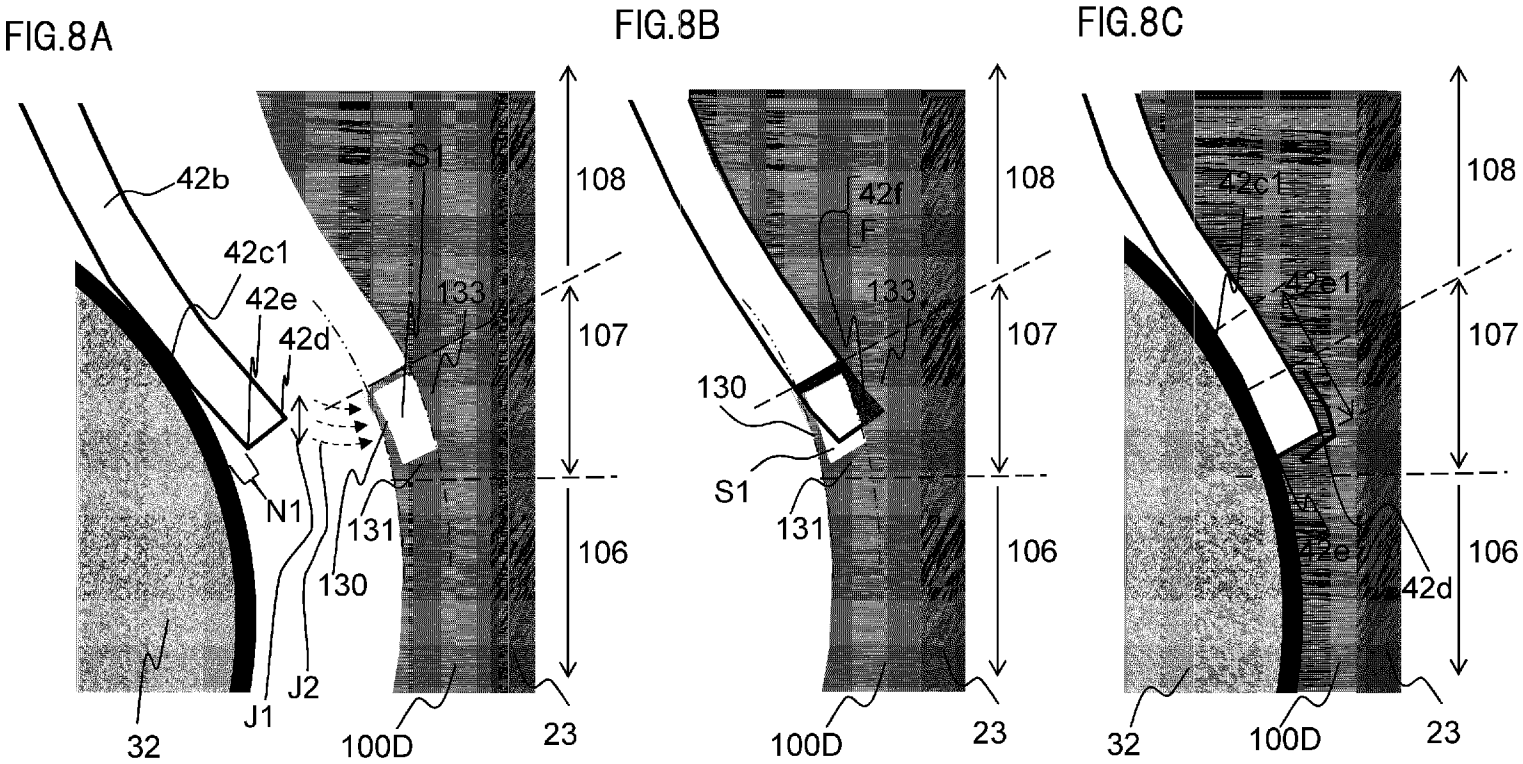

[Fig. 9]

[Fig. 10]
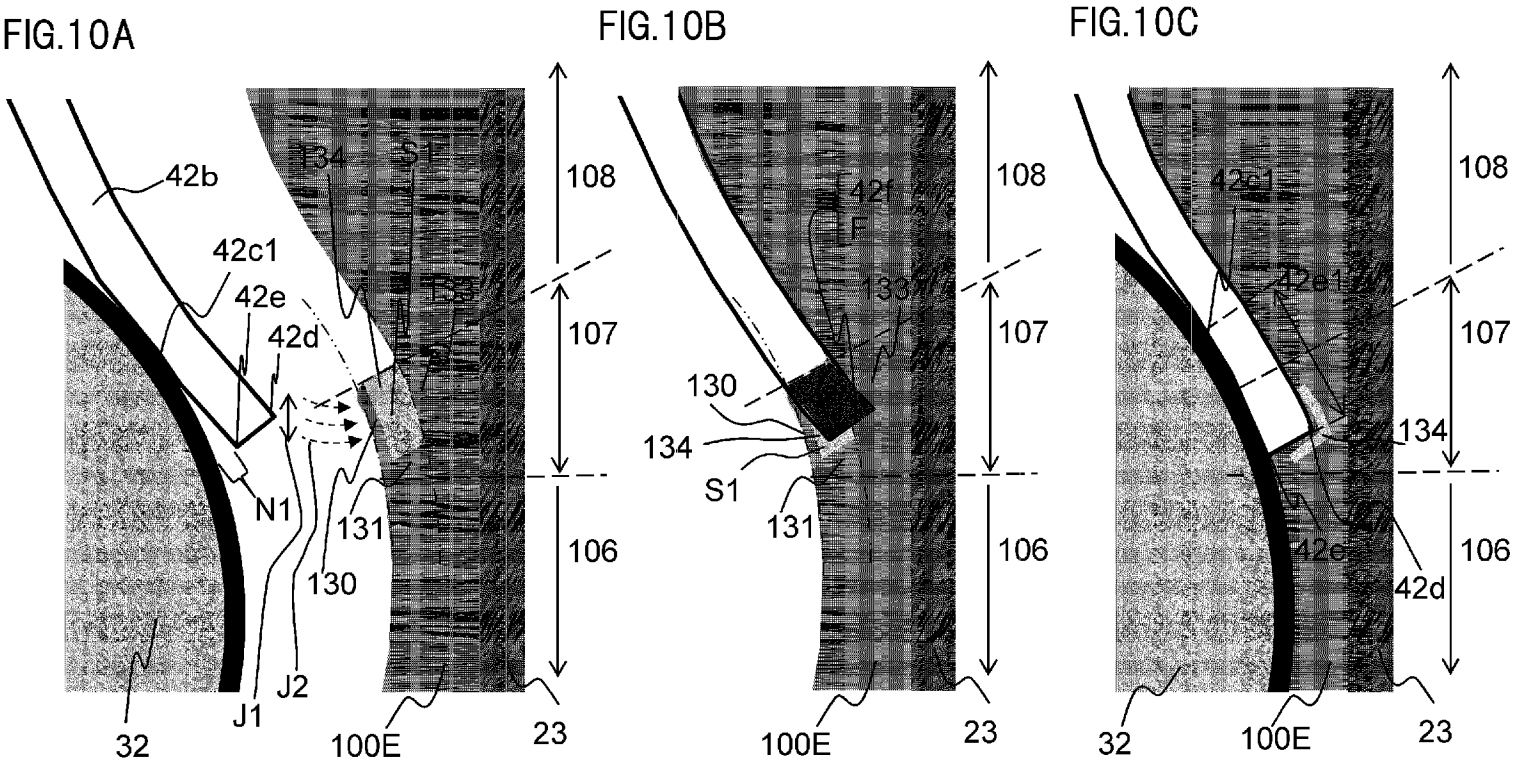

[Fig. 11]

[Fig. 12]
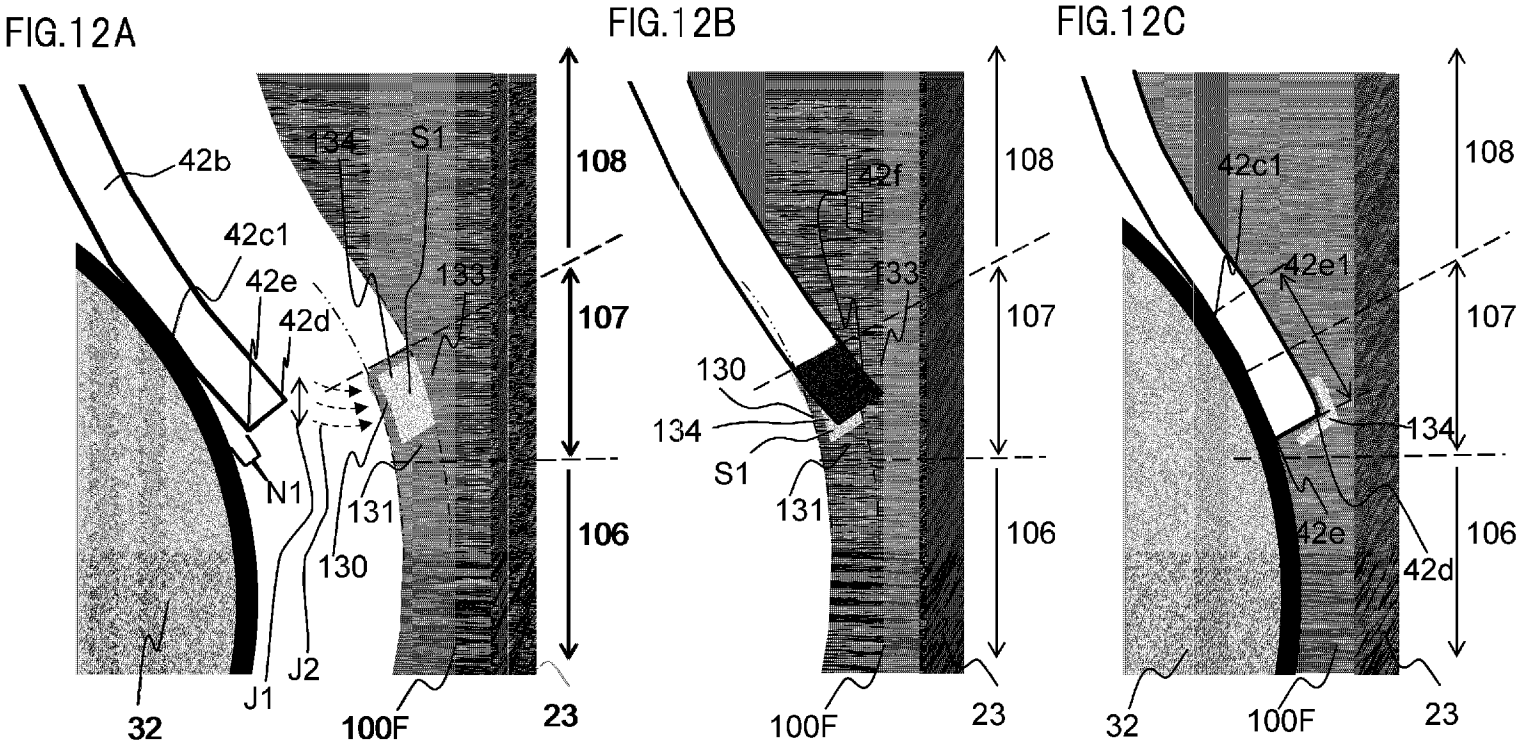

[Fig. 13]

[Fig. 14]
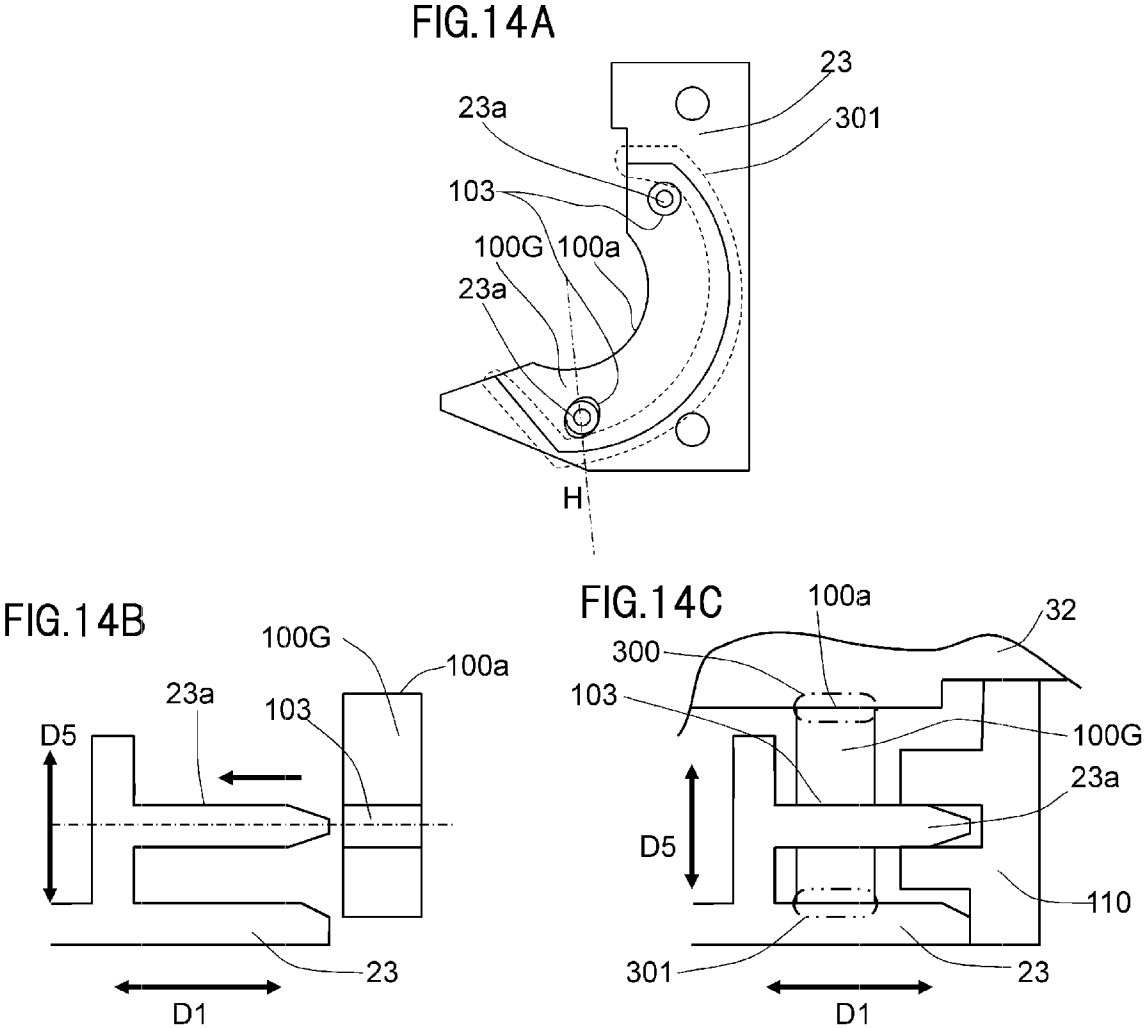

[Fig. 21]
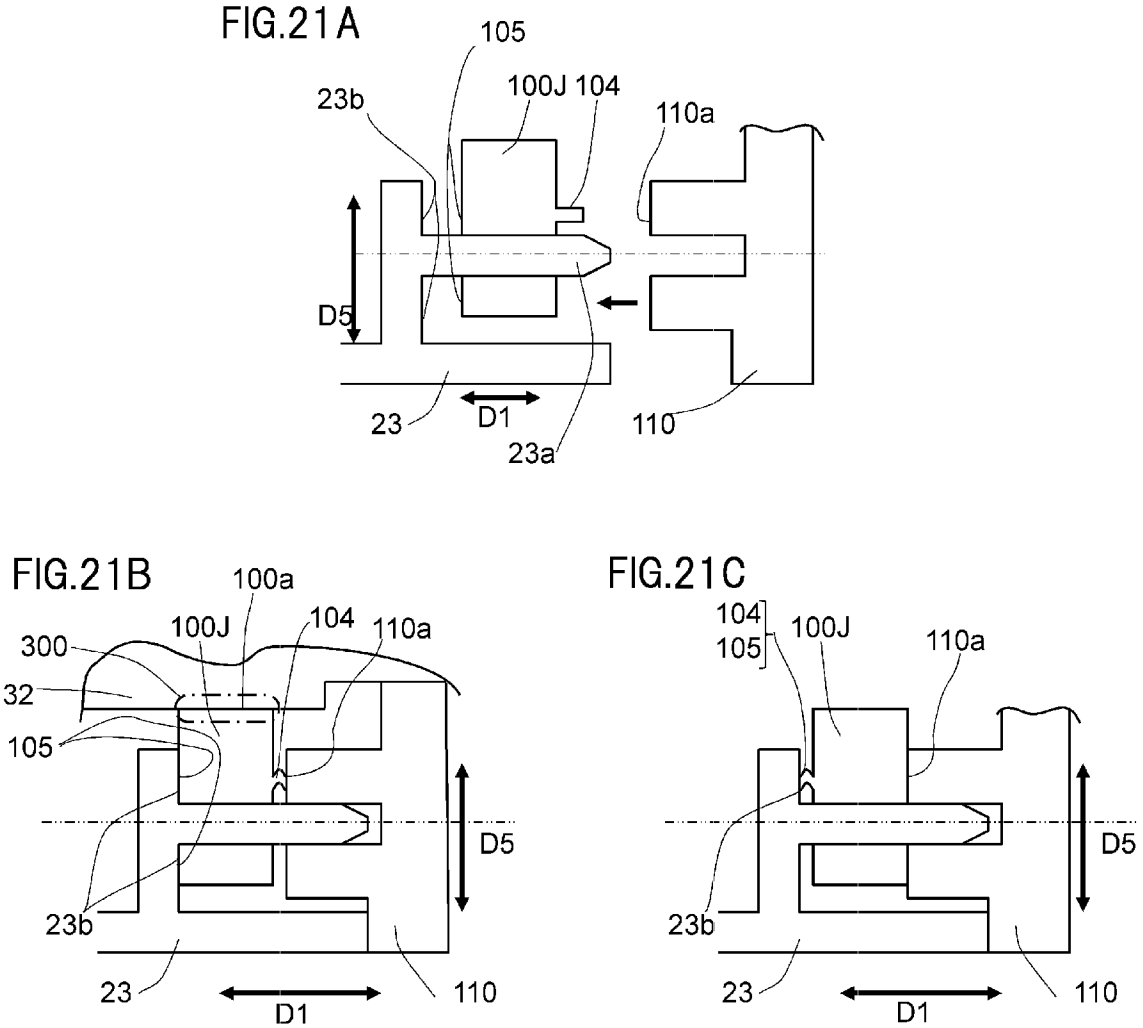

[Fig. 22]

SEAL MEMBER, UNIT, AND IMAGE FORMING APPARATUS

TECHNICAL FIELD

The present invention relates to a seal member in an image forming apparatus and a process cartridge.

BACKGROUND ART

Conventionally, electrophotographic image forming apparatuses (hereinafter, image forming apparatuses) using an electrophotographic image forming process may sometimes adopt a so-called process cartridge system. A process cartridge system refers to an apparatus configuration in which a drum-like electrophotographic photoreceptor (hereinafter, a photosensitive drum) and processing means which acts thereon are integrated as a cartridge and the process cartridge is configured so as to be attachable to and detachable from an apparatus main body of an image forming apparatus. With such a process cartridge, a system is widely adopted in which a seal member is arranged between a cartridge frame body and an end of a rotating body such as a photosensitive drum or a developing roller to suppress or prevent a developer from leaking from the cartridge frame body. Examples of a seal member include those using an elastic body, those using fibers such as pile or felt, and those using a magnetic body.

Among these seal members, as an example of a seal using an elastic body, a seal is proposed in which the seal made of an elastic body is arranged between a rotating body and a frame body, a rib shape parallel to or inclined by approximately 10° with respect to a rubbing surface is provided in plurality on a rubbing surface with the rotating body, and a cantilevered shape with a spring property is provided on a surface that comes into contact with the frame body (PTL 1). In addition, a seal is proposed which is provided with a seat-shaped portion to be engaged with a blade assembly in addition to a portion that comes into contact with a rotating body (PTL 2). Furthermore, a seal member is proposed which is made up of a first surface that comes into contact with a rotating body and at least one printer constituent member and a second surface having a pair of protruding ribs that biases the first surface (PTL 3). The seal member is configured so as to abut the rotating body at a first abutment pressure and abut the printer constituent member at a second abutment pressure, the second abutment pressure made larger than the first abutment pressure by providing a difference in hardness on the second surface.

CITATION LIST

Patent Literature

[PTL 1]
U.S. Pat. No. 6,487,383
[PTL 2]
U.S. Pat. No. 8,116,657
[PTL 3]
U.S. Pat. No. 8,644,725

SUMMARY OF INVENTION

Technical Problem

With process cartridges, a configuration is widely implemented in which a rotating body such as a developing roller and a photosensitive drum is abutted by a blade-like member such as a developer restricting member which restricts a layer thickness of a developer on a surface of the developing roller and a cleaning member which removes residual developer from a surface of the photosensitive drum. In this configuration, a seal member which is positioned at an end of the rotating body and which suppresses or prevents the developer from leaking out from a frame body must fill a gap between the rotating body and the frame body and also fill a gap between the blade and the frame body. In a case of a configuration in which the blade overlaps with the seal member at an end and the blade abuts the rotating body with a surface, the following problem occurs.

FIGS. 4A and 4B are schematic views representing a main part of a periphery of a blade 42*b* when a rotating body 32 is viewed in an axial direction thereof. FIG. 4A represents a state prior to a developing roller 32 and the blade 42*b* abutting each other and FIG. 4B shows a state after the developing roller 32 and the blade 42*b* abut each other. As shown in FIG. 4B, when the blade 42*b* and the developing roller 32 abut each other at surfaces thereof, a range from a developing roller abutting portion 42*c*1 to a developing roller-side edge portion 42*e* of the blade 42*b* does not come into contact with the developing roller 32. As a result, a gap (hereinafter, a tip gap N1) is created at a tip of the blade. Therefore, in order to suppress or prevent the developer from leaking out from a frame body, an occurrence of the tip gap N1 must be suppressed.

Solution to Problem

In consideration thereof, a seal member according to the present invention is a seal member, which is used in a unit including a storage container that stores a developer, a rotating body that is provided in an opening of the storage container, and a blade that abuts the rotating body, and which implements sealing so as to prevent the developer from leaking to the outside of the storage container, the seal member comprising:

a first seal portion which abuts an end of the rotating body in an axial direction of a rotational axis of the rotating body and which implements sealing between the storage container and the rotating body; and a second seal portion which abuts an end of the blade in the axial direction and which implements sealing between the storage container and the blade, wherein the second seal portion includes:

a base portion which is supported by the storage container;

an abutting portion for abutting the blade;

a first connecting portion which is adjacent to the first seal portion and which connects the base portion and the abutting portion to each other; and a wall portion which has a smaller thickness in the axial direction than any of the base portion, the abutting portion, and the first connecting portion, and which is enclosed by the base portion, the abutting portion, and the first connecting portion, and moreover which is connected to at least any one of the base portion, the abutting portion, and the first connecting portion, and the abutting portion deforms in a direction approaching the base portion when the seal member is fixed to the storage container, and the blade and the rotating body are attached.

In addition, another seal member according to the present invention is a seal member, which is used in a unit including a storage container that stores a developer, a rotating body that is provided in an opening of the storage container, and a blade that abuts the rotating body, and which implements sealing so as to prevent the developer from leaking to the outside of the storage container, the seal member comprising:

a first seal portion which abuts an end of the rotating body in an axial direction of a rotational axis of the rotating body and which implements sealing between the storage container and the rotating body; and a second seal portion which abuts an end of the blade in the axial direction and which implements sealing between the storage container and the blade, wherein the second seal portion includes:

a base portion which is supported by the storage container;

an abutting portion for abutting the blade;

a first connecting portion which is adjacent to the first seal portion and which connects the base portion and the abutting portion to each other;

a wall portion which has a smaller thickness in the axial direction than any of the base portion, the abutting portion, and the first connecting portion, and which is enclosed by the base portion, the abutting portion, and the first connecting portion, and moreover which is connected to at least any one of the base portion, the abutting portion, and the first connecting portion; and a area which is enclosed by the base portion, the abutting portion, and the first connecting portion, and the abutting portion deforms in a direction approaching the base portion when the seal member is fixed to the storage container, and the blade and the rotating body are attached.

In addition, another seal member according to the present invention is a seal member, which is used in a unit including a storage container that stores a developer, a rotating body that is provided in an opening of the storage container, and a blade that abuts the rotating body, and which implements sealing so as to prevent the developer from leaking to the outside of the storage container, the seal member comprising:

a second seal portion which abuts an end of the blade in an axial direction of a rotational axis of the rotating body and which implements sealing between the storage container and the blade; and a third seal portion which abuts the blade, wherein the second seal portion includes:

a base portion which is supported by the storage container; an abutting portion for abutting the blade;

a first connecting portion which connects the base portion and the abutting portion to each other on a side of an end, which abuts the rotating body, of the blade; and a wall portion which has a smaller thickness in the axial direction than any of the base portion, the abutting portion, and the first connecting portion, and which is enclosed by the base portion, the abutting portion, and the first connecting portion, and moreover which is connected to at least any one of the base portion, the abutting portion, and the first connecting portion, and the abutting portion deforms in a direction approaching the base portion when the seal member is fixed to the storage container, and the blade and the rotating body are attached.

In addition, another seal member according to the present invention is a seal member, which is used in a unit including a storage container that stores a developer, a rotating body that is provided in an opening of the storage container, and a blade that abuts the rotating body, and which implements sealing so as to prevent the developer from leaking to the outside of the storage container, the seal member comprising:

a second seal portion which abuts an end of the blade in an axial direction of a rotational axis of the rotating body and which implements sealing between the storage container and the blade; and a third seal portion which abuts the blade, wherein the second seal portion includes:

a base portion which is supported by the storage container; an abutting portion for abutting the blade;

a first connecting portion which connects the base portion and the abutting portion to each other on a side of an end, which abuts the rotating body, of the blade;

a second connecting portion which connects the base portion and the abutting portion to each other; and an area which is enclosed by the base portion, the abutting portion, the first connecting portion, and the second connecting portion, and the abutting portion deforms in a direction approaching the base portion when the seal member is fixed to the storage container, and the blade and the rotating body are attached.

In addition, another seal member according to the present invention is a seal member, which is used in a unit including a storage container that stores a developer, a rotating body that is provided in an opening of the storage container, and a blade that abuts the rotating body, and which implements sealing so as to prevent the developer from leaking to the outside of the storage container, the seal member comprising:

a first seal portion which abuts an end of the rotating body in an axial direction of a rotational axis of the rotating body and which implements sealing between the storage container and the rotating body; and a second seal portion which abuts an end of the blade in the axial direction and which implements sealing between the storage container and the blade, wherein the second seal portion overlaps with an end of the blade so as to enclose the end of blade from an abutting surface of the end of the blade, which abuts the rotating body, to a tip surface and to a surface on an opposite side to the abutting surface when the second seal portion in a state of not abutting the blade and the rotating body and the end of the blade in a state of not abutting the second seal portion but abutting the rotating body are viewed in the axial direction in a positional relationship that exists upon completion of assembly.

In addition, another seal member according to the present invention is a seal member, which is used in a unit including a storage container that stores a developer, a rotating body that is provided in an opening of the storage container, and a blade that abuts the rotating body, and which implements sealing so as to prevent the developer from leaking to the outside of the storage container, the seal member comprising:

a first seal portion which abuts an end of the rotating body in an axial direction of a rotational axis of the rotating body and which implements sealing between the storage container and the rotating body; and a second seal portion which abuts an end of the blade in the axial direction and which implements sealing between the storage container and the blade, wherein the second seal portion includes:

a region which overlaps with an end of the blade when the second seal portion in a state of not abutting the blade and the rotating body and the end of the blade in a state of not abutting the second seal portion but abutting the rotating body are viewed in the axial direction in a positional relationship that exists upon completion of assembly; and a concave portion having a first close contact surface which conforms to a surface on an opposite side to an abutting surface, which abuts the rotating body, of the end of the blade and a second close contact surface which conforms to a tip surface of the end of the blade when the second seal portion in a state of not abutting the blade and the rotating body and the end of the blade in a state of abutting along a surface of the rotating body are viewed in the axial direction in a positional relationship that exists upon completion of assembly.

In addition, a unit according to the present invention is a unit which is attachable to and detachable from an apparatus main body of an image forming apparatus, the unit comprising:

a storage container that stores a developer;

a developer bearing member;

a blade which abuts the developer bearing member; and a seal member including a first seal portion which abuts an end of the developer bearing member in an axial direction of a rotational axis of the developer bearing member and which implements sealing between the storage container and the developer bearing member and a second seal portion which abuts an end of the blade in the axial direction and which implements sealing between the storage container and the blade, wherein the second seal portion includes:

a base portion which is supported by the storage container; an abutting portion for abutting the blade;

a first connecting portion which is adjacent to the first seal portion and which connects the base portion and the abutting portion to each other; and a wall portion which has a smaller thickness in the axial direction than any of the base portion, the abutting portion, and the first connecting portion, and which is enclosed by the base portion, the abutting portion, and the first connecting portion, and moreover which is connected to at least any one of the base portion, the abutting portion, and the first connecting portion, and the abutting portion deforms in a direction approaching the base portion when the seal member is fixed to the storage container, and the blade and the developer bearing member are attached.

In addition, another unit according to the present invention is a unit which is attachable to and detachable from an apparatus main body of an image forming apparatus, the unit comprising:

a storage container that stores a developer;

a developer bearing member;

a blade which abuts the developer bearing member; and a seal member including a first seal portion which abuts an end of the developer bearing member in an axial direction of a rotational axis of the developer bearing member and which implements sealing between the storage container and the developer bearing member and a second seal portion which abuts an end of the blade in the axial direction and which implements sealing between the storage container and the blade, wherein the second seal portion includes:

a base portion which is supported by the storage container; an abutting portion for abutting the blade;

a first connecting portion which is adjacent to the first seal portion and which connects the base portion and the abutting portion to each other;

a wall portion which has a smaller thickness in the axial direction than any of the base portion, the abutting portion, and the first connecting portion, and which is enclosed by the base portion, the abutting portion, and the first connecting portion, and moreover which is connected to at least any one of the base portion, the abutting portion, and the first connecting portion; and an area which is enclosed by the base portion, the abutting portion, and the first connecting portion, and the abutting portion deforms in a direction approaching the base portion when the seal member is fixed to the storage container, and the blade and the developer bearing member are attached.

In addition, another unit according to the present invention is a unit which is attachable to and detachable from an apparatus main body of an image forming apparatus, the unit comprising:

a storage container that stores a developer;

a developer bearing member;

a blade which abuts the developer bearing member; and a seal member including a second seal portion which abuts an end of the blade in an axial direction of a rotational axis of the developer bearing member and which implements sealing between the storage container and the blade and a third seal portion which abuts the blade, wherein the second seal portion includes:

a base portion which is supported by the storage container;

an abutting portion for abutting the blade;

a first connecting portion which connects the base portion and the abutting portion to each other on a side of an end, which abuts the developer bearing member, of the blade; and a wall portion which has a smaller thickness in the axial direction than any of the base portion, the abutting portion, and the first connecting portion, and which is enclosed by the base portion, the abutting portion, and the first connecting portion, and moreover which is connected to at least any one of the base portion, the abutting portion, and the first connecting portion, and the abutting portion deforms in a direction approaching the base portion when the seal member is fixed to the storage container, and the blade and the developer bearing member are attached to the storage container.

In addition, another unit according to the present invention is a unit which is attachable to and detachable from an apparatus main body of an image forming apparatus, the unit comprising:

a storage container that stores a developer;

a developer bearing member;

a blade which abuts the developer bearing member; and a seal member including a second seal portion which abuts an end of the blade in an axial direction of a rotational axis of the developer bearing member and which implements sealing between the storage container and the blade and a third seal portion which abuts the blade, wherein the second seal portion includes:

a base portion which is supported by the storage container;

an abutting portion for abutting the blade;

a first connecting portion which connects the base portion and the abutting portion to each other on a side of an end, which abuts the developer bearing member, of the blade;

a second connecting portion which connects the base portion and the abutting portion to each other; and an area which is enclosed by the base portion, the abutting portion, the first connecting portion, and the second connecting portion, and the abutting portion deforms in a direction approaching the base portion when the seal member is fixed to the storage container, and the blade and the developer bearing member are attached to the storage container.

Further features of the present invention will become apparent from the following description of exemplary embodiments (with reference to the attached drawings).

BRIEF DESCRIPTION OF DRAWINGS

FIGS. 6A to 6C are diagrams illustrating a configuration of a seal member according to a second example.

FIGS. 7A to 7C are diagrams illustrating a configuration of a seal member according to a third example.

FIGS. 8A to 8C are diagrams illustrating a configuration of a seal member according to a fourth example.

FIGS. 10A to 10C are diagrams illustrating a configuration of a seal member according to a fifth example.

FIGS. 12A to 12C are diagrams illustrating a configuration of a seal member according to a sixth example.

FIGS. 14A to 14C are diagrams illustrating a configuration of a seal member according to the eighth example.

FIGS. 21A to 21C are diagrams illustrating a configuration of a seal member according to the eleventh example.

DESCRIPTION OF EMBODIMENTS

An embodiment of the present invention will now be exemplarily described in detail based on examples with reference to the drawings. It is to be understood that dimensions, materials, shapes, relative arrangements, and the like of components described in the embodiment are intended to be changed as deemed appropriate in accordance with configurations and various conditions of apparatuses to which the present invention is to be applied. In other words, the scope of the present invention is not intended to be limited to the embodiment described below.

First Example

The present invention relates to a developing apparatus, a developing cartridge, and a process cartridge, and to an image forming apparatus using these components. A developing apparatus refers to an apparatus which includes a developing roller (a developer bearing member) that bears a developer on a surface thereof and which uses the developer to convert an electrostatic latent image formed on a photosensitive drum (an image bearing member) by the developing roller into a visible image. A developing cartridge refers to a cartridge which integrates the developing apparatus described above and which is attachably and detachably mounted with respect to an image forming apparatus main body. In addition, a process cartridge refers to a cartridge which integrates a photosensitive drum and a developing apparatus that acts on the photosensitive drum and which is attachably and detachably mounted with respect to an image forming apparatus main body. Furthermore, an image forming apparatus refers to an apparatus that forms an image on a recording medium (a recording material) using an electrophotographic image forming system. Examples of an electrophotographic image forming apparatus include an electrophotographic copier, an electrophotographic printer (such as an LED printer and a laser beam printer), a facsimile device, and a word processor.

An image forming apparatus according to a first example of the present invention will be described with reference to FIGS. 1 to 5D. Moreover, in the following description, a rotational axis direction of a photosensitive drum 62 (hereinafter, a drum 62) and a developing roller 32 arranged parallel to the drum 62 will be denoted by D1.

Figure 2:
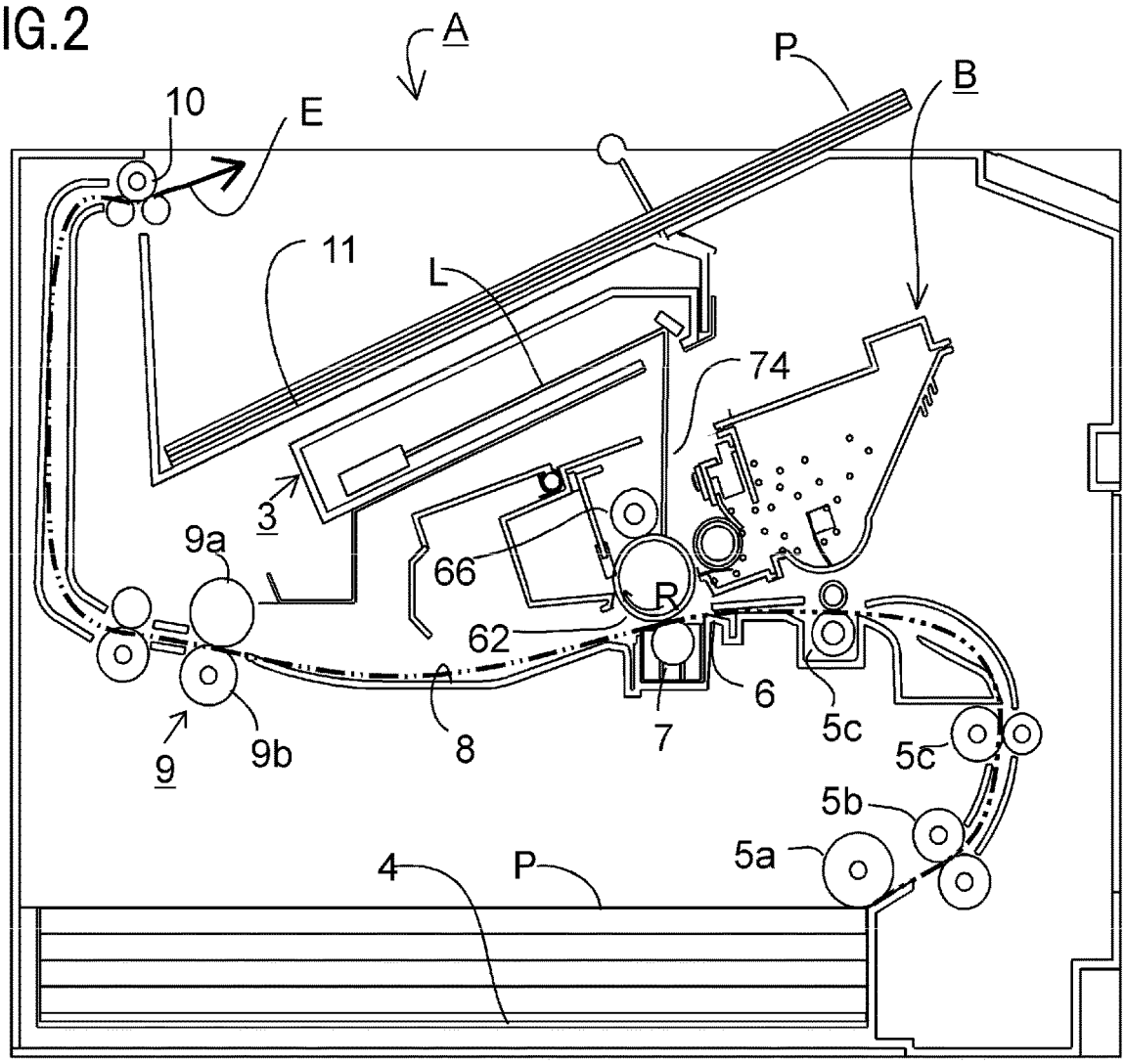
FIG. 2 is a main sectional view of an image forming apparatus according to an example of the present invention.
Figure 3:
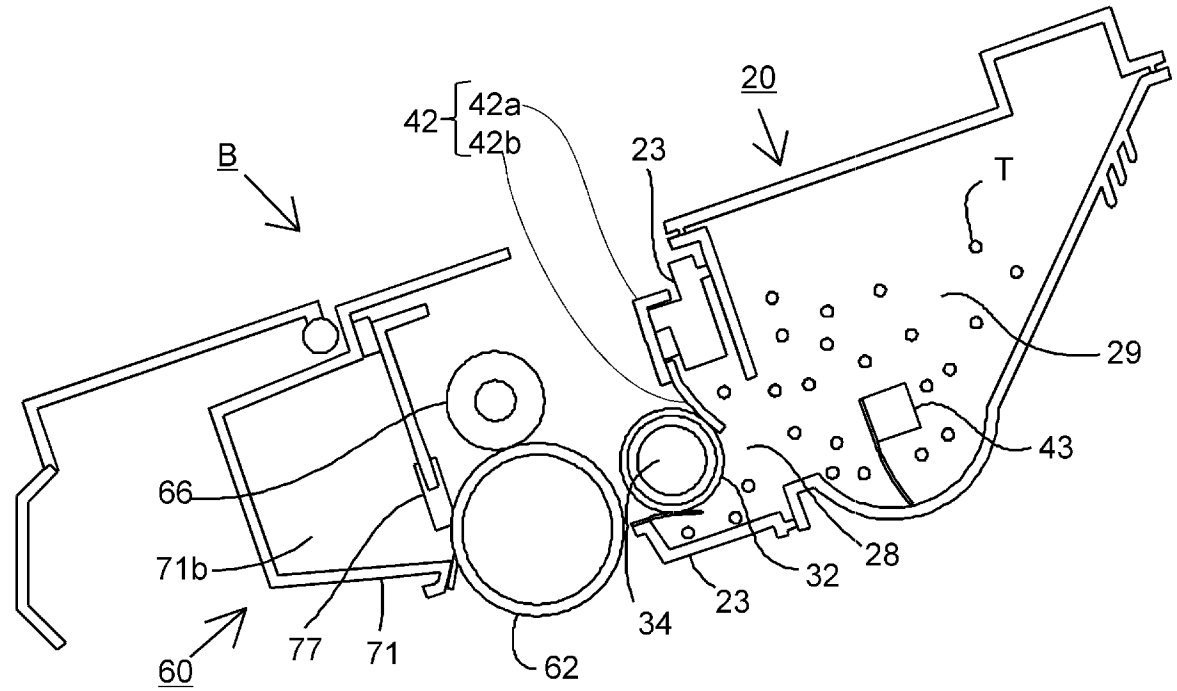
FIG. 3 is a main sectional view of a process cartridge according to an example of the present invention.

An overall configuration and an image forming process of an image forming apparatus according to the present example will now be described with reference to FIGS. 2 and 3. FIG. 2 is a schematic sectional view showing a configuration of an image forming apparatus according to an example of the present invention, the image forming apparatus according to the present example generally being constituted by an apparatus main body A and a process cartridge B (hereinafter, a cartridge B). FIG. 3 is a sectional view of the cartridge B. In this case, the apparatus main body A refers to a constituent portion excluding the cartridge B in an apparatus configuration of the image forming apparatus.

<Overall Configuration of Electrophotographic Image Forming Apparatus>

As shown in FIG. 2, the image forming apparatus according to the present example is a laser beam printer in which the cartridge B is configured to be attachable and detachable with respect to the apparatus main body A and which uses electrophotographic technology. This is an arrangement configuration in which, when the cartridge B is mounted to the apparatus main body A, an exposing apparatus 3 (a laser scanner unit) is positioned above the cartridge B. In addition, a sheet tray 4 storing a recording medium (hereinafter, described as a sheet material P) that is an image formation object is arranged below the cartridge B.

Furthermore, in the apparatus main body A, a pickup roller 5*a*, a feeding roller pair 5*b*, a conveying roller pair 5*c*, a transfer guide 6, a transfer roller 7, a conveying guide 8, a fixing apparatus 9, a discharge roller pair 10, a discharge tray 11, and the like are sequentially arranged in a conveyance direction E of the sheet material P.

<Image Forming Process>

Based on a print start signal, the drum 62 is rotationally driven in a direction of an arrow R at a prescribed circumferential speed (process speed). A charging roller 66 to which a bias voltage is applied comes into contact with an outer circumferential surface of the drum 62 and uniformly charges the outer circumferential surface of the drum 62. The exposing apparatus 3 outputs laser light L in accordance with image information. The laser light L passes through an exposure window 74 on an upper surface of the cartridge B and scans and exposes the outer circumferential surface of the drum 62. Accordingly, an electrostatic latent image (an electrostatic image) corresponding to the image information is formed on the outer circumferential surface of the drum 62.

Meanwhile, as shown in FIG. 3, in a developing apparatus unit 20 as a developing apparatus, toner T (a developer) in a toner chamber 29 is stirred and conveyed by a rotation of a conveying member 43 and sent into a toner supply chamber 28. The toner T is borne on a surface of the developing roller (a developing sleeve) 32 due to a magnetic force of a magnet roller 34 (a fixed magnet). As the toner T is frictionally charged by a developing blade 42, a layer thickness of the toner T on a circumferential surface of the developing roller 32 is restricted. The toner T is transferred to the drum 62 in accordance with the electrostatic latent image and creates a visible image in the form of a toner image (a developer image).

In addition, as shown in FIG. 2, at a same timing as output of the laser light L, the sheet material P stored in the sheet tray 4 in a lower part of the apparatus main body A is fed from the sheet tray 4. Subsequently, the sheet material P passes by the transfer guide 6 and is supplied to a transfer position (a transfer nip portion) between the drum 62 and the transfer roller 7. At the transfer position, the toner image is sequentially transferred from the drum 62 to the sheet material P. The sheet material P on which the toner image has been transferred is subjected to a pressure and heat fixing process in which the sheet material P is sandwiched and conveyed by a fixing nip portion formed by a heating member 9*a* and a pressurizing member 9*b* of the fixing apparatus 9 and, as a result, the toner image is fixed onto the sheet material P. After being subjected to the toner image fixing process, the sheet material P is conveyed to the discharge roller pair 10 and discharged to the discharge tray 11.

Meanwhile, as shown in FIG. 3, residual toner on the outer circumferential surface of the drum 62 after the transfer is removed by a cleaning blade 77 and the drum 62 is once again used in an image forming process. The toner removed from the drum 62 is stored in a waste toner chamber 71*b* of a cleaning unit 60.

In the configuration described above, the charging roller 66, the developing roller 32, and the cleaning blade 77 are processing means that act on the drum 62.

<Overall Configuration of Cartridge>

An overall configuration of the cartridge B will be described with reference to FIG. 3. The cartridge B is constructed by uniting the cleaning unit 60 and the developing apparatus unit 20. The cleaning unit 60 is constituted by a cleaning frame body 71, the drum 62, the charging roller 66, the cleaning blade 77, and the like. Meanwhile, the developing apparatus unit 20 is constituted by a developer container 23, a first side member (not shown), a second side member (not shown), the developing blade 42, the developing roller 32, the magnet roller 34, the conveying member 43, the toner T, and the like. The cartridge B is constructed by joining the cleaning unit 60 and the developing apparatus unit 20 so as to be mutually rotatable.

<Configuration of Cleaning Unit>

A configuration of the cleaning unit 60 will be described with reference to FIG. 3. The cleaning blade 77 removes residual toner from the outer circumferential surface of the drum 62. The removed toner is stored in the waste toner chamber 71*b* of the cleaning unit 60. The charging roller 66 is biased with respect to the drum 62 and is driven so as to rotate with a rotation of the drum 62. The drum 62 is rotatably supported by the cleaning frame body 71.

<Configuration of Developing Apparatus Unit>

A configuration of the developing apparatus unit 20 will be described with reference to FIGS. 3 and 16. The developing blade 42 is constituted by a supporting member 42*a* made of a sheet metal and an elastic member 42*b* made of an elastic material such as urethane rubber and is fixed at a prescribed position by having both longitudinal ends of the supporting member 42*a* fixed by screws 150 to the developer container 23 that is a storage container for storing the developer. The elastic member 42*b* abuts the developing roller 32 that is a rotating body provided so as to be rotatable in an opening of the developer container 23, restricts an amount of toner on a circumferential surface of the developing roller 32 and, at the same time, imparts a frictional electrostatic charge to the circumferential surface of the developing roller 32.

<Configuration of Seal Member>

Figure 1:
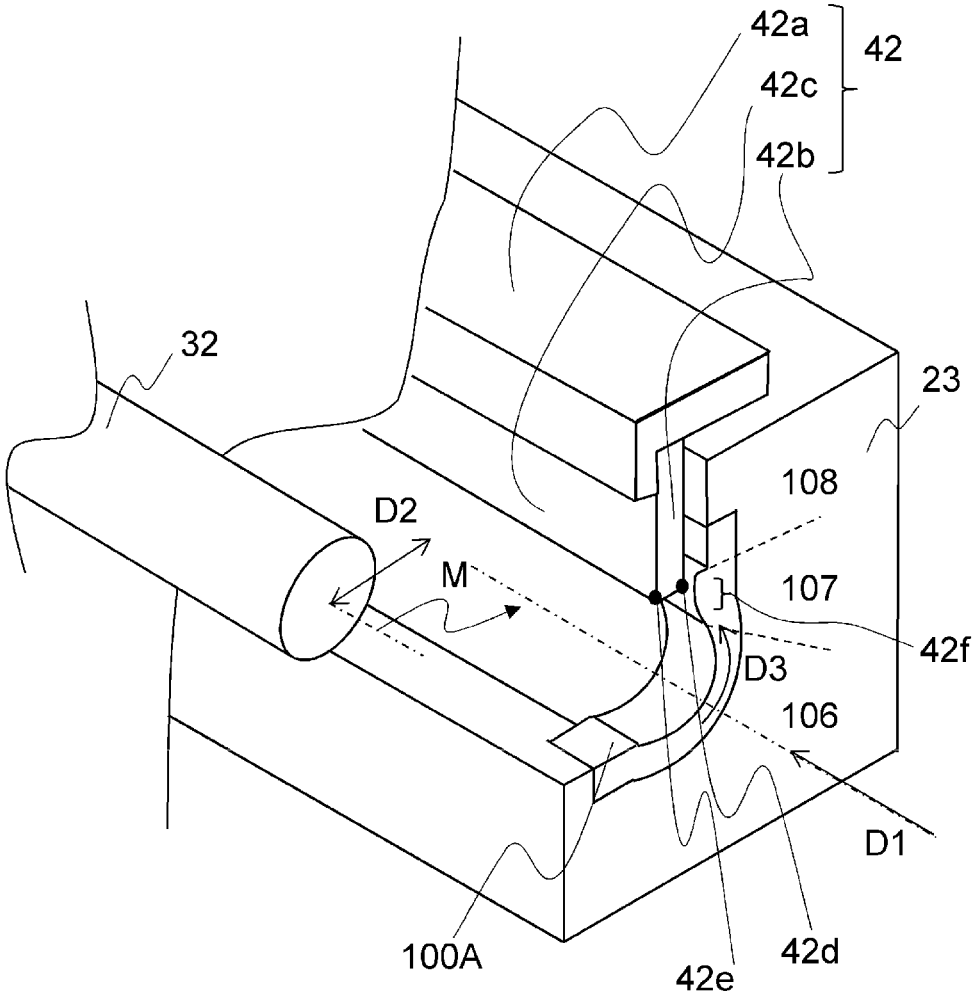
FIG. 1 is a perspective view showing a main part of a periphery of a seal member according to a first example of the present invention.

A configuration of a seal member according to the present example will be described with reference to FIGS. 1, 4A, 4B, 5A to 5D. FIG. 1 is a schematic perspective view representing a main part of a periphery of a seal member 100A provided in the developer container 23. FIGS. 5A to 5D are schematic views illustrating a configuration of the seal member 100A according to the first example. FIGS. 5A, 5B, and 5C are diagrams showing a main part of a vicinity of the elastic member 42*b* when a process cartridge in which the seal member 100A made of an elastic body is arranged is viewed in a rotational axis direction D1 of the developing roller 32 shown in FIG. 1. FIG. 5D is a plan view from a direction D4 of a region in which the elastic member 42*b* and the seal member 100A overlap with each other as viewed from a side of the developer container 23 in a radial direction D2 of the developing roller 32 in a state shown in FIG. 5C. A state of abutment of the elastic member 42*b* and the developing roller 32 as viewed in the rotational axis direction D1 when the seal member 100A according to the first example is not arranged is as shown in FIGS. 4A and 4B.

The image forming apparatus (process cartridge) according to the present example includes the seal member 100A configured so as to fill a gap between the developer container 23, the developing roller 32, and the developing blade 42 in order to suppress leakage of toner from inside of the developer container 23 to the outside. The seal member 100A is integrally molded to the developer container 23. The seal member 100A may be integrally molded to the developer container 23 by being molded at the same time as molding of the developer container 23 by, for example, so-called two-color molding or may be integrally molded afterwards to the molded developer container 23. While a type of a resin material used in the seal member is not particularly limited, the resin material is appropriately selected from the perspectives of slidability with the developing roller 32, a pressure contact force and adhesiveness with respect to the developing blade 42 (the elastic member 42*b*) and the developing roller 32, compatibility with a resin material used in the developer container 23, and the like.

Therefore, assembly of the process cartridge according to the present example is performed by first assembling the developing blade 42 to the developer container 23 with which the seal member 100A is integrated and subsequently assembling the developing roller 32. The developing roller 32 is assembled from a side of a surface 42*c* on a side of the developing roller 32 of the elastic member 42*b* along a route denoted by an arrow M in FIG. 1. The elastic member 42*b* is in a state shown in FIG. 4A before abutting the developing roller 32 and changes to a state shown in FIG. 4B after abutting the developing roller 32. FIGS. 5A and 5B also show a state after the elastic member 42*b* abuts the developing roller 32. The developing roller 32 is assembled to the developer container 23 such that, after abutting the elastic member 42*b*, the developing roller 32 abuts the seal member 100A while causing the elastic member 42*b* to curve and deform as shown in FIGS. 4B and 5B. FIG. 5C is a diagram showing a state where assembly of the developing roller 32 to the developer container 23 has been completed.

Figure 4A:
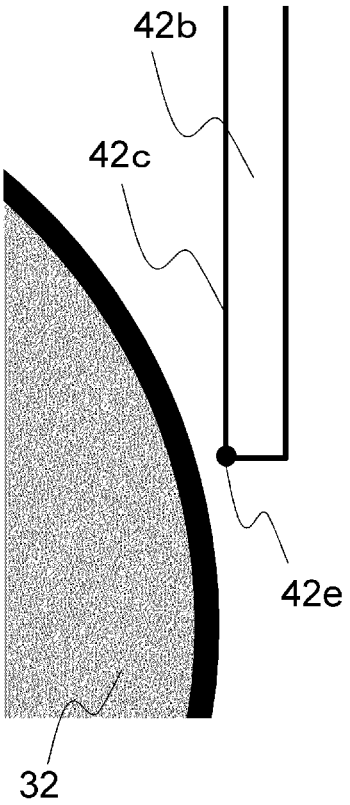
FIGS. 4A and 4B are diagrams of a main part of a periphery of a blade in a configuration in which a seal member is not arranged.
Figure 4B:
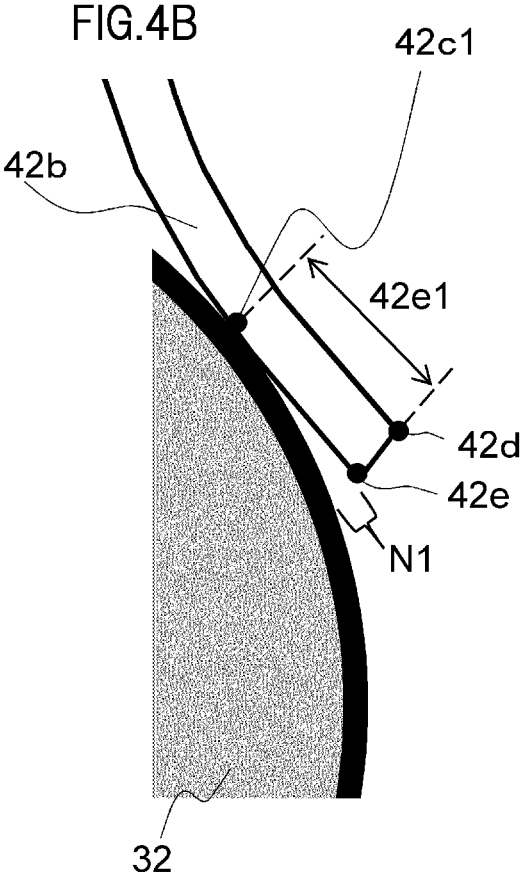
Figure 5A:
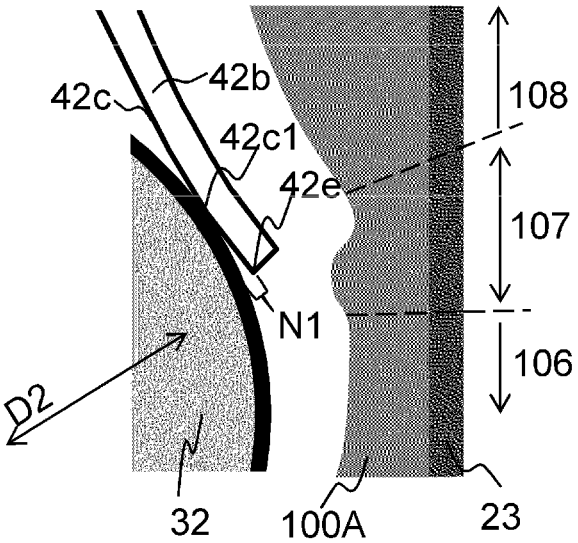
FIGS. 5A to 5D are diagrams illustrating a configuration of a seal member according to the first example.
Figure 5B:
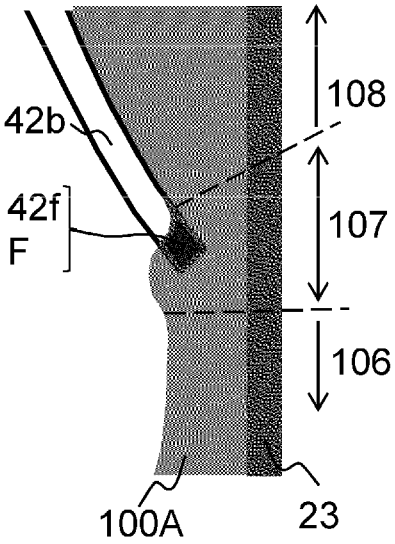
Figure 5C:
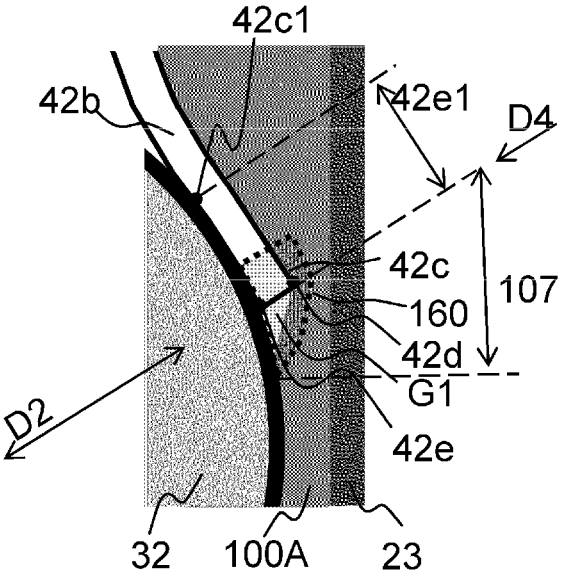
Figure 5D:
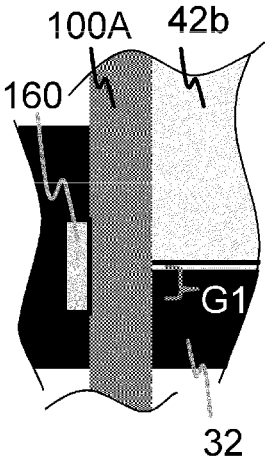
Figure 9:
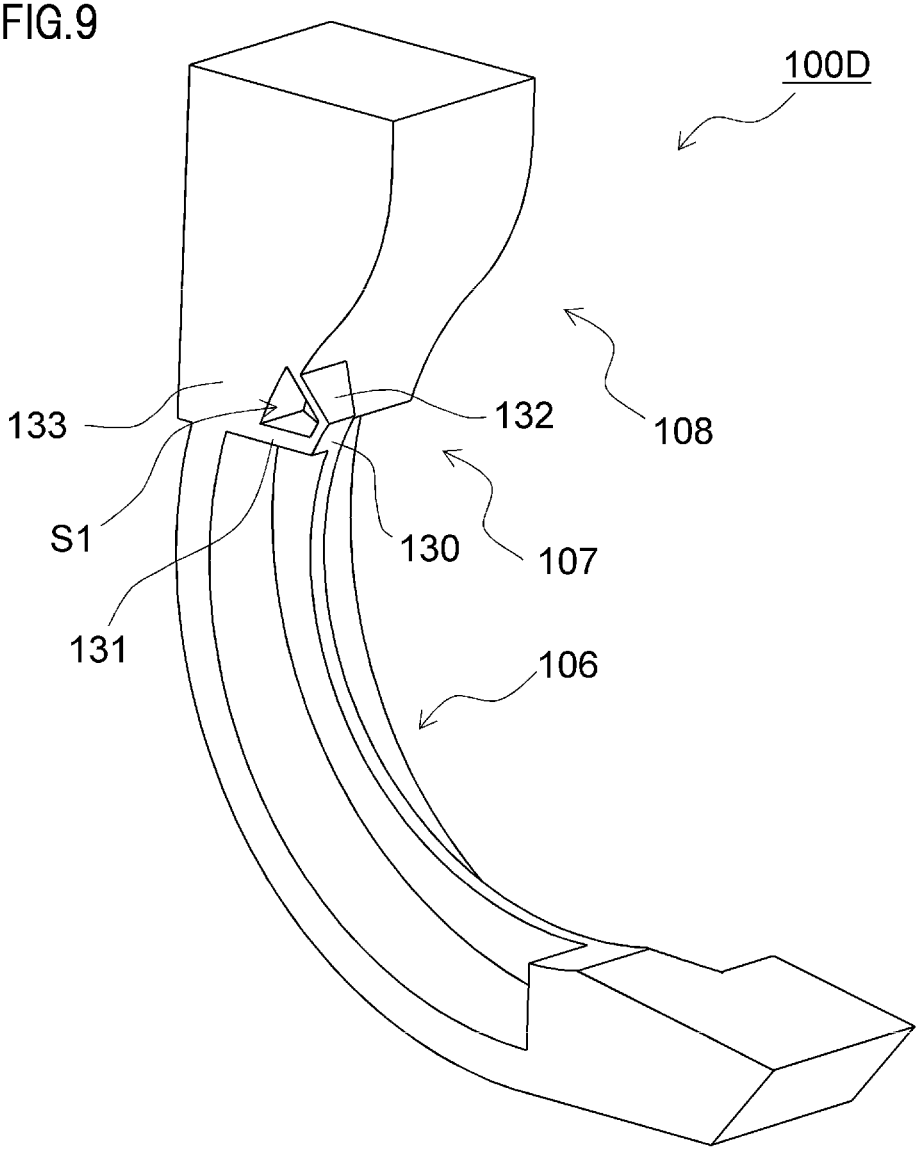
FIG. 9 is a diagram illustrating a configuration of a seal member according to the fourth example.

As shown in FIG. 4A, the elastic member 42*b* has a flat plate shape and extends in an axial direction of the developing roller 32. The elastic member 42*b* and the developing roller 32 have different surface curvatures. As shown in FIG. 4B, the surface 42*c* of the elastic member 42*b* on the side of the developing roller 32 abuts the developing roller 32 with a certain width (a developing roller abutting portion 42*c*1) in the axial direction D1 of the developing roller 32. As a result, the elastic member 42*b* warps and deforms. The deformation that occurs on the elastic member 42*b* due to the elastic member 42*b* abutting the developing roller 32 is such that the further away from an abutment position with the developing roller 32, the greater the spacing from the developing roller 32. Accordingly, a tip side of the elastic member 42*b* with respect to an abutting portion with the developing roller 32 or, in other words, a range (hereinafter, a tip region 42*e*1) from the developing roller abutting portion 42*c*1 to a developing roller-side edge portion 42*e* of the elastic member 42*b* does not abut the developing roller 32. Therefore, when the seal member 100A does not press the elastic member 42*b* or when pressing is insufficient, a gap (a tip gap N1) is created after unit assembly between the tip region 42*e*1 of the elastic member 42*b* and the developing roller 32.

FIG. 5B is a diagram showing a relationship between shapes of the elastic member 42*b* and the seal member 100A, in which the elastic member 42*b* in a deformed state due to the elastic member 42*b* abutting the developing roller 32 and the seal member 100A in an undeformed state are shown overlapping with each other in a positional relationship that exists upon completion of mounting of the developing roller 32. In the drawing, reference character F denotes a region in which a space occupied by the seal member 100A when the elastic member 42*b* and the developing roller 32 are not arranged in the developer container 23 and a space occupied by the elastic member 42*b* in a state of abutment with the developing roller 32 when the seal member 100A is not arranged in the developer container 23 overlap with each other. The seal member 100A is constituted by a first seal portion 106 which abuts the developing roller 32, a second seal portion 107 which abuts both the elastic member 42*b* and the developing roller 32, and a third seal portion 108 which abuts the elastic member 42*b*, and the second seal portion 107 includes an elastic member tip pressing portion 42*f*.

In this case, as shown in FIG. 5B, the elastic member tip pressing portion 42*f* refers to a region where the seal member 100A and the elastic member 42*b* in the illustrated state overlap with each other or, in other words, a portion in the second seal portion 107 which corresponds to the region F where the two spatial regions described above overlap with each other. The elastic member tip pressing portion 42*f* is in a positional relationship in which the elastic member tip pressing portion 42*f* presses the tip region 42*e*1 described earlier when the seal member 100A is fixed to the developer container 23 and the elastic member 42*b* and the developing roller 32 are attached. Accordingly, as shown in FIG. 5C, the tip region 42*e*1 at a position overlapping with the second seal portion 107 in the axial direction D1 of the developing roller can be deformed along the surface of the developing roller 32 as though pressed against the surface and can be abutted with the developing roller 32. As a result, the elastic member 42*b* can be deformed so as to suppress the occurrence of the tip gap N1 shown in FIG. 4B.

In addition, since the seal member 100A is integrally molded to the developer container 23 in the present example, the developer is prevented from leaking from between the seal member 100A and the developer container 23. Moreover, as shown in FIG. 5C, depending on a thickness of the elastic member 42*b*, a stepped gap G1 may be created between the tip (a tip surface) of the elastic member 42*b* and the second seal portion 107. As shown in FIG. 5D, the stepped gap G1 can be filled by arranging, in a vicinity of the seal member 100A, separate sealing means 160 (translucently illustrated in FIG. 5C) (a second seal member) which is larger than the stepped gap G1. Accordingly, leakage of the developer from the toner supply chamber 28 can be suppressed or prevented in a more reliable manner.

As described above, a feature of the seal member 100A according to the first example is that the seal member 100A is provided in the second seal portion 107 with the elastic member tip pressing portion 42*f* that causes the elastic member 42*b* to deform so that a tip portion of the elastic member 42*b* comes into close contact along the surface of the developing roller 32. The second seal portion 107 in a state where the second seal portion 107 is not abutting the developing roller 32 and the elastic member 42*b* has a region that overlaps with the elastic member 42*b* in a state where a deformation has occurred due to the elastic member 42*b* abutting the developing roller 32 in a positional relationship upon completion of mounting of the developing roller (upon completion of assembly) when viewed in the axial direction D1. More specifically, a configuration is adopted in which the second seal portion 107 in the state described above overlaps with the tip portion of the elastic member 42*b* in the state described above so as to enclose a region from an abutting surface of the tip portion with the developing roller 32 to a tip surface and to a surface on an opposite side to the abutting surface. This overlapping region forms the elastic member tip pressing portion 42*f*. Due to this configuration, an occurrence of a gap between the tip portion of the elastic member 42*b* and the developing roller 32 can be suppressed and leakage of a developer can be prevented.

Second Example

A seal member 100B according to a second example of the present invention will be described mainly with reference to FIGS. 6A to 6C. FIGS. 6A to 6C are diagrams illustrating a configuration of the seal member 100B according to the second example and is a schematic view as viewed in the rotational axis direction D1 of the developing roller 32. The seal member 100B according to the second example is configured so as to be provided in advance with a stepped shape corresponding to the elastic member 42*b*. In the second example, components in common with those of the first example are assigned same reference characters and redundant descriptions thereof will be omitted. Matters not described in the second example are similar to those described in the first example.

FIG. 6A is a diagram showing the elastic member 42*b* and the developing roller 32, which abut each other, being separated from the seal member 100B. As indicated by a solid line in FIG. 6A, in a state where the elastic member 42*b* is not pressed by the seal member 100B (the elastic member tip pressing portion 42*f*), the tip region 42*e*1 of the elastic member 42*b* does not abut the developing roller 32. The elastic member tip pressing portion 42*f* of the seal member 100B according to the present example presses the elastic member 42*b* so that, as indicated by a dashed line in FIG. 6A, the tip region 42*e*1 of the elastic member 42*b* deforms in a shape conforming to the surface of the developing roller 32 and abuts the developing roller 32. The elastic member tip pressing portion 42*f* in the second example is configured so as to include a stepped shape corresponding to a shape when the elastic member 42*b* abuts the developing roller 32 indicated by the dashed line in FIG. 6A.

FIG. 6B is a diagram showing a relationship between shapes of the elastic member 42*b* and the seal member 100B, in which the elastic member 42*b* in a deformed state due to the elastic member 42*b* abutting the developing roller 32 and the seal member 100B in an undeformed state are shown overlapping with each other in a positional relationship that exists upon completion of mounting of the developing roller. As is apparent from FIG. 6B, the elastic member 42*b* prior to being pressed by the seal member 100B as indicated by a solid line is in a positional relationship in which the elastic member 42*b* partially overlaps with the seal member 100B. A portion 42*f* at which the elastic member 42*b* and the seal member 100B overlap with each other is in a positional relationship in which the tip region 42*e*1 is pressed toward the developing roller 32 when the developing roller 32 is attached and has a similar function to the elastic member tip pressing portion 42*f* according to the first example.

FIG. 6C is a diagram showing a state upon completion of mounting of a developing roller. As a result of the tip region 42*e*1 having been pressed by the elastic member tip pressing portion 42*f*, the elastic member 42*b* enters a state indicated by a dashed line and, as shown in FIG. 6C, the tip region 42*e*1 abuts the developing roller 32 in a gapless manner. In addition, due to the second seal portion 107 having a shape corresponding to the elastic member 42*b*, an occurrence of the stepped gap G1 (FIGS. 5C and 5D) which occurs in the first example and which is created due to a thickness of the elastic member 42*b* can also be suppressed. Accordingly, leakage of the developer from the toner supply chamber 28 can be suppressed or prevented.

As described above, a feature of the seal member 100B according to the second example is that the seal member 100B is provided in the second seal portion 107 with the elastic member tip pressing portion 42*f* that causes the elastic member 42*b* to deform so that a tip portion of the elastic member 42*b* comes into close contact along the surface of the developing roller 32. In addition, a feature of the seal member 100B according to the second example is that the seal member 100B has a shape corresponding to a shape of the elastic member 42*b* when the tip region 42*e*1 pressed by the elastic member tip pressing portion 42*f* deforms so as to abut (come into close contact) along the surface of the developing roller 32 in a gapless manner. Specifically, the elastic member tip pressing portion 42*f* has a concave portion which includes a first close contact surface along a non-sliding surface on an opposite side to a sliding surface that abuts the developing roller 32 of the elastic member 42*b* in the deformed state described above and a second close contact surface along a tip surface of the elastic member 42*b* in the same state. The first close contact surface and the second close contact surface of the concave portion are configured so as to respectively come into close contact with the non-sliding surface and the tip surface of the elastic member 42*b* upon completion of mounting of the developing roller. Due to this configuration, a sealed state can be formed in which, in addition to suppressing an occurrence of a gap between the tip portion of the elastic member 42*b* and the developing roller 32, an occurrence of the stepped gap G1 that is created due to the thickness of the elastic member 42*b* is also suppressed. In addition, due to having a shape emulating the shape of the elastic member 42*b* in a deformed state, the elastic member tip pressing portion 42*f* according to the second example is prevented from causing the elastic member 42*b* to be excessively pressed against the developing roller 32 and a pressing force thereof is prevented from becoming locally excessive.

Third Example

A seal member 100C according to a third example of the present invention will be described mainly with reference to FIGS. 7A to 7C. FIGS. 7A to 7C are diagrams illustrating a configuration of the seal member 100C according to the third example and is a schematic view as viewed in the rotational axis direction D1 of the developing roller 32. The seal member 100C according to the third example is configured so that the second seal portion 107 is provided with an abutting portion (a deforming seal portion) that is configured to deform so as to fill a gap between the second seal portion 107 and the tip portion of the elastic member 42*b* when abutting the elastic member 42*b*. In the third example, components in common with those of the examples described above are assigned same reference characters and redundant descriptions thereof will be omitted. Matters not described in the third example are similar to those of the examples described above.

FIG. 7A is a diagram showing the elastic member 42*b* and the developing roller 32, which abut each other, being separated from the seal member 100C. As shown in FIG. 7A, the second seal portion 107 includes an abutting portion 130 which abuts the elastic member 42*b*, a base portion 133 in contact with the developer container 23, and a first connecting portion 131 which connects the abutting portion 130 and the base portion 133 on an end side of the elastic member 42*b* and which is adjacent to the first seal portion 106. An area S1 enclosed by the abutting portion 130, the base portion 133, and the first connecting portion 131 is formed among these portions.

FIG. 7B is a diagram showing a relationship between shapes of the elastic member 42*b* and the seal member 100C, in which the elastic member 42*b* in a deformed state due to the elastic member 42*b* abutting the developing roller 32 and the seal member 100C in an undeformed state are shown overlapping with each other in a positional relationship that exists upon completion of mounting of the developing roller.

In the third example, the second seal portion 107 similarly includes the elastic member tip pressing portion 42*f*. In a similar manner to the first example, the elastic member tip pressing portion 42*f* is a portion corresponding to the region F overlapping with the elastic member 42*b* in the second seal portion 107 shown in FIG. 7B.

FIG. 7C is a diagram showing a state upon completion of mounting of a developing roller. In the configuration of the third example, the abutting portion 130 is configured so as to be capable of deforming significantly in a direction of the base portion 133. Therefore, when the elastic member 42*b* and the developing roller 32 are attached to the developer container 23 to which the seal member 100C is fixed, the abutting portion 130 deforms in a direction approaching the base portion 133 as a result of the abutting portion 130 abutting the elastic member 42*b* which deforms by being pressed by the developing roller 32. In addition, as shown in FIG. 7C, as the developing roller 32 reaches a final assembly position of the developer container 23, the abutting portion 130 collides with the connecting portion 131 and the base portion 133 and enters a state of being compressed between the tip of the elastic member 42*b* and the connecting portion 131 and the base portion 133. In this state, the abutting portion 130, the base portion 133, and the first connecting portion 131 form the elastic member tip pressing portion 42*f* according to the third example. In other words, a state is created where, in a similar manner to the elastic member tip pressing portion 42*f* according to the first and second examples, the abutting portion 130, the base portion 133, and the first connecting portion 131 press the tip region 42*e*1 of the elastic member 42*b* and causes the tip portion of the elastic member 42*b* to abut (come into close contact) along the circumferential surface of the developing roller 32. As a result, even in the third example, the elastic member 42*b* can be deformed so as to suppress the occurrence of the tip gap N1 (FIG. 7A) in a similar manner to the first example.

In addition, as shown in FIG. 7A, a tip position of the elastic member 42*b* which is constituted by a seal-side edge portion 42*d* of the elastic member 42*b* and a developing roller 32 side edge portion 42*e* of the elastic member 42*b* may conceivably have variations in manufacturing as indicated by an arrow J1 in the drawing. Therefore, as indicated by an arrow J2, a position where the seal-side edge portion 42*d* of the elastic member 42*b* and the abutting portion 130 abut each other also has variations. In the third example, the abutting portion 130, the first connecting portion 131, and the area S1 are configured so as to be provided in a range that is potentially abutted by the elastic member 42*b*. Accordingly, even if the position where the elastic member 42*b* abuts the abutting portion 130 varies due to variations in manufacturing or the like, the seal-side edge portion 42*d* of the elastic member 42*b* can be more reliably caused to abut the abutting portion 130. Therefore, even if the position where the elastic member 42*b* abuts the abutting portion 130 varies, a state where the elastic member tip pressing portion 42*f* presses the tip region 42*e*1 can be created and, eventually, as shown in FIG. 7C, the tip region 42*e*1 can be caused to abut the developing roller 32. In other words, according to the third example, dimensional errors in manufacturing of the respective members can be absorbed and an occurrence of the tip gap N1 and an occurrence of the stepped gap G1 can be suppressed in a more reliable manner.

As described above, the seal member 100C according to the third example includes the abutting portion 130 which, upon assembly of the developing roller 32, deforms as a result of abutting the elastic member 42*b* and enters a state where the abutting portion 130 is sandwiched between the tip portion of the elastic member 42*b* and the second seal portion 107 so as to fill a gap between these portions. In addition, a feature of the seal member 100C according to the third example is that the seal member 100C has a shape corresponding to a shape of the elastic member 42*b* when the base portion 133 of the second seal portion 107 and the third seal portion 108 deform so that the tip portion 42*e*1 abuts (comes into close contact) along the surface of the developing roller 32 in a gapless manner. Therefore, a close contact state is created where an opposite surface to the surface that comes into close contact with the developing roller 32 of the elastic member 42*b*, the base portion 133, and the third seal portion 108 come into close contact with one another. Furthermore, a close contact state is created where the tip portion of the elastic member 42*b*, and the base portion 133 and the connecting portion 131 of the second seal portion, come into close contact with one another via the abutting portion 130 which is deformed and compressed therebetween. Due to the creation of these close contact states, a sealed state is created between the seal member 100C and the elastic member 42*b*. In particular, the configuration that creates the latter close contact state constitutes the elastic member tip pressing portion 42*f* according to the present example. In the apparatus configuration, a positional relationship between the tip of the elastic member 42*b* and the seal member 100C (an abutment position of the tip of the elastic member 42*b* and the seal member 100C) is susceptible to fluctuations under the influence of dimensional variations in manufacturing. According to the present example, with a configuration that creates a close contact state due to the deformation and compression of the abutting portion 130, dimensional variations in manufacturing of the respective constituent members can be absorbed and a sealed state can be more reliably created. In addition, the abutting portion 130 also functions as a buffer portion that reduces a pressing force of the elastic member tip pressing portion 42*f* with respect to the elastic member 42*b* and is capable of keeping a torque low during driving of the developing roller 32.

In the present example, the abutting portion 130 is given a plate-like configuration which has a thickness such that the abutting portion 130 succumbs to pressing by the elastic member 42*b* during assembly of the developing roller and deforms and which protrudes in a cantilevered manner from a side of the first seal portion 106 toward a side of the third seal portion 108 while maintaining spacing with the base portion 133. Although one of the reasons for adopting such a shape configuration is ease of manufacturing by die molding, manufacturing may be performed using other methods such as cutting. When pressed by the elastic member 42*b* during assembly of the developing roller, the abutting portion 130 deforms so that a tip side bends down (toward a side of the concave portion) so as to approach the base portion 133 with a root portion (an edge portion of the concave portion) that continues to the connecting portion 131 as a base point. In addition, the abutting portion 130 finally enters a state where the abutting portion 130 is pressed against the base portion 133 and the connecting portion 131 by the elastic member 42*b*. Specifically, the abutting portion 130 is pressed against a concave portion which includes a surface (a first close contact surface) of the base portion 133 along a non-sliding surface on an opposite side to a sliding surface on which the elastic member 42*b* abuts the developing roller 32 and a surface (a second close contact surface) along a tip surface of the elastic member 42*b* in the connecting portion 131. However, the configuration of the abutting portion 130 is not limited to the configuration described in the present example. Any other configuration may be adopted as the configuration of the abutting portion 130 as long as the configuration enables the abutting portion 130 to abut the tip portion of the elastic member 42*b* and deform so as to fill a gap between the tip portion of the elastic member 42*b*, the base portion 133, and the connecting portion 131 even when the variations in positional relationships described earlier occur.

Fourth Example

A seal member 100D according to a fourth example of the present invention will be described mainly with reference to FIGS. 8A to 8C and 9. FIGS. 8A to 8C are diagrams illustrating a configuration of the seal member 100D according to the fourth example and is a schematic view as viewed in the rotational axis direction D1 of the developing roller 32. FIGS. 8A to 8C are schematic perspective views illustrating a configuration of the seal member 100D according to the fourth example. The seal member 100D according to the fourth example is configured such that, in a similar manner to the third example, the second seal portion 107 is provided with an abutting portion and a connecting portion (a deforming seal portion) which are configured to deform so as to fill a gap between the second seal portion 107 and the tip portion of the elastic member 42*b* when abutting the elastic member 42*b*. In the fourth example, components in common with those of the examples described above are assigned same reference characters and redundant descriptions thereof will be omitted. Matters not described in the fourth example are similar to those of the examples described above.

FIG. 8A is a diagram showing the elastic member 42*b* and the developing roller 32, which abut each other, being separated from the seal member 100D. FIG. 8B is a diagram showing a relationship between shapes of the elastic member 42*b* and the seal member 100D, in which the elastic member 42*b* in a deformed state due to the elastic member 42*b* abutting the developing roller 32 and the seal member 100D in an undeformed state are shown overlapping with each other in a positional relationship that exists upon completion of mounting of the developing roller. FIG. 8C is a diagram showing a state upon completion of mounting of a developing roller. As shown in FIGS. 8A to 8C and 9, a configuration of the seal member 100D according to the fourth example is obtained by adding a second connecting portion 132 which connects the abutting portion 130 and the base portion 133 to each other and which is adjacent to the third seal portion 108 to the configuration described in the third example. Due to the presence of the second connecting portion 132, the abutting portion 130 can be placed in an approximately constrained state and more reliably abutted with the seal-side edge portion 42*d* of the elastic member 42*b*, and leakage of the developer from the developer container 23 can be suppressed.

As described above, the seal member 100D according to the fourth example includes the abutting portion 130 and the second connecting portion 132 as a deforming seal portion. The seal member 100D is also provided with a concave portion which includes a surface (a first close contact surface) of the base portion 133 along a non-sliding surface on an opposite side to a sliding surface on which the elastic member 42*b* abuts the developing roller 32 and a surface (a second close contact surface) along a tip surface of the elastic member 42*b* in the connecting portion 131. The abutting portion 130 and the second connecting portion 132 form an arch-like deforming seal portion (an arch-like abutting portion) which straddles the concave portion. The abutting portion 130 and the second connecting portion 132 deform due to pressing by the elastic member 42*b* upon assembly of the developing roller and eventually enter a state of being sandwiched (compressed) between the tip portion of the elastic member 42*b*, the base portion 133, and the first connecting portion 131 (a concave portion) so as to fill a gap created therebetween. In particular, due to the second connecting portion 132 being connected, deformation of the abutting portion 130 is orientated and an appropriate compressed state in the gap can be more reliably created. Accordingly, leakage of the developer from between the elastic member 42*b* and the seal member 100D can be suppressed. In addition, the abutting portion 130 and the second connecting portion 132 also function as a buffer portion that reduces a pressing force of the elastic member tip pressing portion 42*f* with respect to the elastic member 42*b* and are capable of keeping a torque low during driving of the developing roller 32. The abutting portion 130 and the second connecting portion 132 may be configured in any way as long as the configuration has a thickness such that the abutting portion 130 and the second connecting portion 132 succumb to pressing by the elastic member 42*b* during assembly of the developing roller and deform and the configuration ensures an abutment with the tip portion of the elastic member 42*b* and a deformation so as to fill the gap described above are performed even when the variations in positional relationships described earlier occur. In other words, the configuration of the abutting portion 130 and the second connecting portion 132 is not limited to the configuration described above. Moreover, although a shape configuration of the abutting portion 130 and the second connecting portion 132 according to the present example is adopted in consideration of ease of manufacturing by die molding, manufacturing may be performed using other methods such as cutting.

Fifth Example

Figures 11A, 11B:
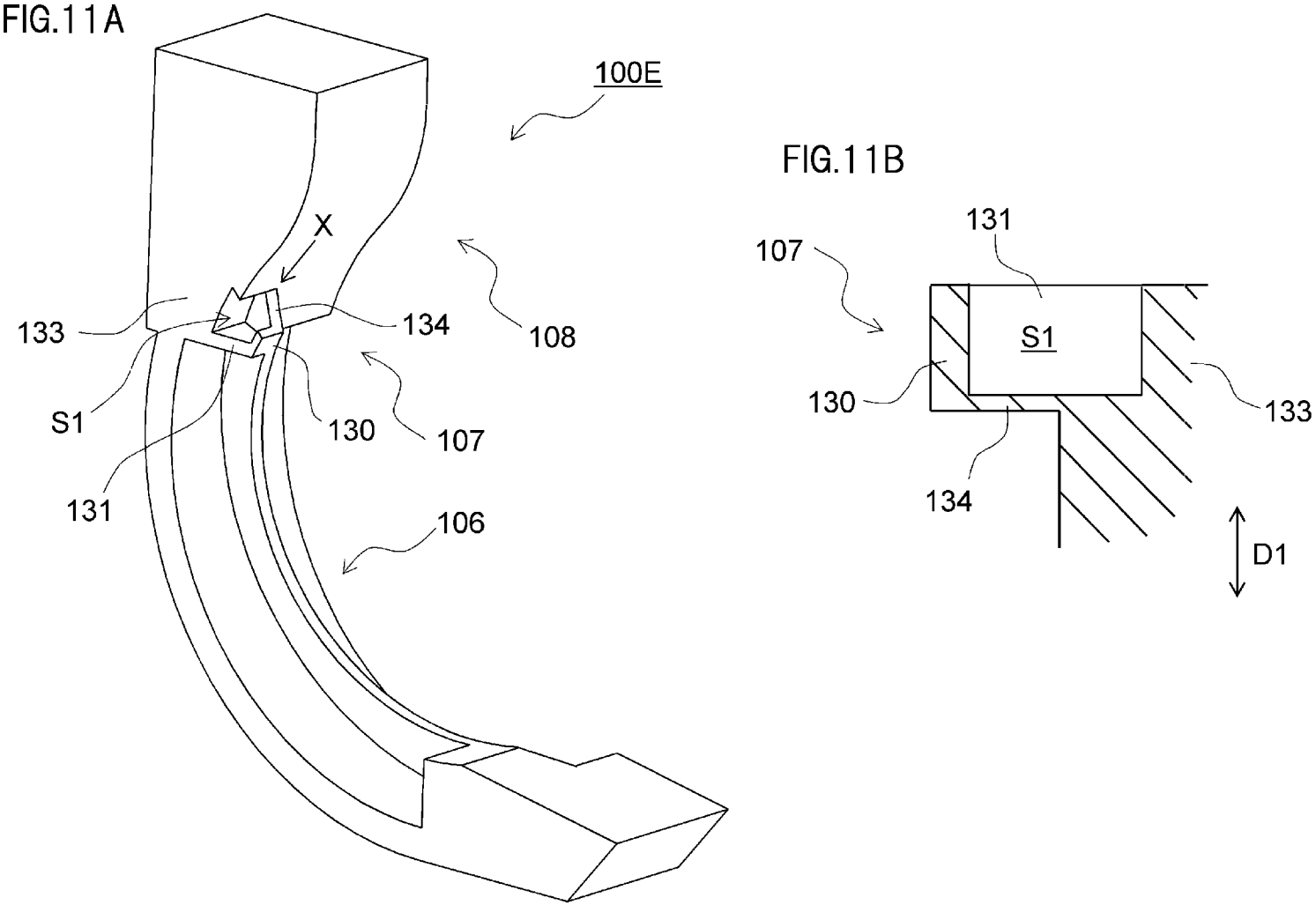
FIGS. 11A and 11B are diagrams illustrating a configuration of a seal member according to the fifth example.

A seal member 100E according to a fifth example of the present invention will be described mainly with reference to FIGS. 10A to 10C, 11A and 11B. FIGS. 10A to 10C are diagrams illustrating a configuration of the seal member 100E according to the fifth example and is a schematic view as viewed in the rotational axis direction D1 of the developing roller 32. FIG. 11A is a schematic perspective view illustrating a configuration of the seal member 100E according to the fifth example, and FIG. 11B is a schematic sectional view showing a configuration of the second seal portion 107 as viewed in a direction of an arrow X in FIG. 11A. In the fifth example, components in common with those of the examples described above are assigned same reference characters and redundant descriptions thereof will be omitted. Matters not described in the fifth example are similar to those of the examples described above.

A configuration of the seal member 100E is obtained by adding a wall portion 134 which is enclosed by the abutting portion 130, the first connecting portion 131, and the base portion 133 and connected to at least any one of these portions and which has a smaller thickness in the axial direction D1 than any of these portions to the configuration described in the third example. The wall portion 134 according to the present example is configured with a thickness and a shape capable of filling a gap created among the abutting portion 130, the base portion 133, and the first connecting portion 131 even in a deformed state where the wall portion 134 does not abut any of these portions. By providing the wall portion 134 configured in this manner, amounts by which the abutting portion 130 and the base portion 133 are compressed between the elastic member 42*b* and the developer container 23 can be reduced. Therefore, according to the configuration of the present example, in addition to being able to suppress or prevent leakage of the developer, a pressing force of the elastic member tip pressing portion 42*f* with respect to the elastic member 42*b* can be reduced and a torque during driving of the developing roller 32 can be kept low.

As described above, the seal member 100E according to the fifth example includes the abutting portion 130 and the wall portion 134 as a deforming seal portion. The abutting portion 130 and the wall portion 134 deform due to pressing by the elastic member 42*b* upon assembly of the developing roller and eventually enter a state of being sandwiched (compressed) between the tip portion of the elastic member 42*b*, the base portion 133, and the first connecting portion 131 so as to fill a gap created therebetween. Accordingly, leakage of the developer from between the elastic member 42*b* and the seal member 100E can be suppressed. In addition, the abutting portion 130 and the wall portion 134 also function as a buffer portion that reduces a pressing force of the elastic member tip pressing portion 42*f* with respect to the elastic member 42*b* and are capable of keeping a torque low during driving of the developing roller 32. The abutting portion 130 and the wall portion 134 may be configured in any way as long as the configuration has a thickness such that the abutting portion 130 and the wall portion 134 succumb to pressing by the elastic member 42*b* during assembly of the developing roller and deform and the configuration ensures an abutment with the tip portion of the elastic member 42*b* and a deformation so as to fill the gap are performed even when the variations in positional relationships described earlier occur. In other words, the configuration of the abutting portion 130 and the wall portion 134 is not limited to the configuration described above. Moreover, although a shape configuration of the abutting portion 130 and the wall portion 134 according to the present example is adopted in consideration of ease of manufacturing by die molding, manufacturing may be performed using other methods such as cutting. In addition, the wall portion 134 may be provided on an interior side of the container (a distal side with respect to the area S1) as shown in FIGS. 10A to 10C or on an exterior side of the container (a proximal side with respect to the area S1) as shown in FIGS. 11A and 11B.

Sixth Example

A seal member 100F according to a sixth example of the present invention will be described mainly with reference to FIGS. 12A to 12C. FIGS. 12A to 12C are diagrams illustrating a configuration of the seal member 100F according to the sixth example and is a schematic view as viewed in the rotational axis direction D1 of the developing roller 32. In the sixth example, components in common with those of the examples described above are assigned same reference characters and redundant descriptions thereof will be omitted. Matters not described in the sixth example are similar to those of the examples described above. A configuration of the seal member 100F is obtained by providing the second connecting portion 132 described in the fourth example and the wall portion 134 described in the fifth example in addition to the configuration described in the third example. Adopting the configuration of the present example enables the abutting portion 130 to be reliably abutted with the seal-side edge portion 42*d* of the elastic member 42*b* in a similar manner to the fourth example and enables a pressing force with respect to the elastic member to be reduced in a similar manner to the fifth example.

Seventh Example

The seal members according to the respective examples described above may be constructed by respectively split-molding the first seal portion 106, the second seal portion 107, and the third seal portion 108 as separate bodies and mutually bonding the portions with an adhesive or the like into a single seal member. Alternatively, the seal members may be constructed by respectively molding the first seal portion 106, the second seal portion 107, and the third seal portion 108 as separate bodies and individually bonding the portions to the developer container 23 with an adhesive or the like. In doing so, a configuration may be adopted in which assembly is performed by bonding the first seal portion 106 and the third seal portion 108 (adhesion portions) to the developer container 23 and sandwiching the second seal portion 107 (a non-adhesion portion) between the first seal portion 106 and the third seal portion 108 using an elastic force.

In addition, the first seal portion 106 and the second seal portion 107 may be integrally molded and only the third seal portion 108 may be separately molded or the second seal portion 107 and the third seal portion 108 may be integrally molded and only the first seal portion 106 may be separately molded. Since the integrated seal portions can be molded into a shape without seams between the seal portions, it is needless to say that an improvement in seal performance can be achieved. It is also needless to say that, by integrally molding all of the seal portions and creating a state where the seal member 100 does not have any seams, seal performance can be further improved and effects similar to those of the first to sixth examples can be produced in a more reliable manner.

Eighth Example

Figure 13A:
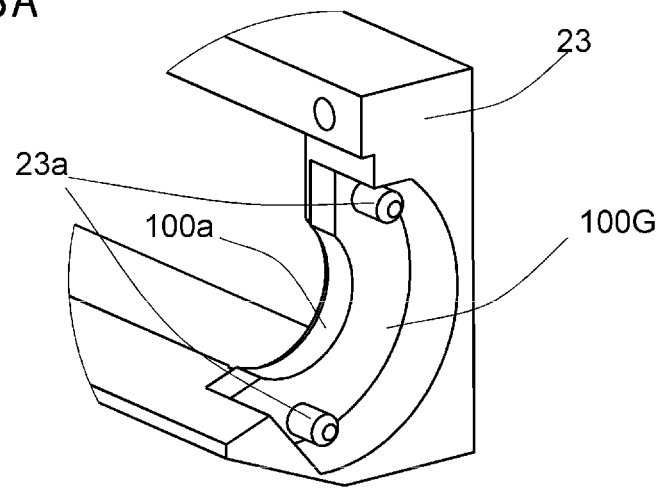
FIGS. 13A and 13B are diagrams illustrating a configuration of a seal member according to an eighth example.
Figure 13B:
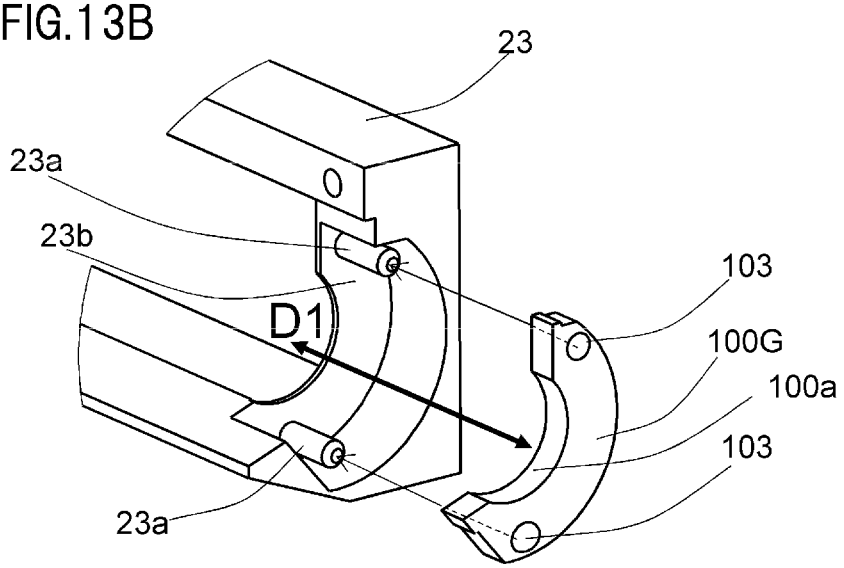
Figures 16A, 16B:
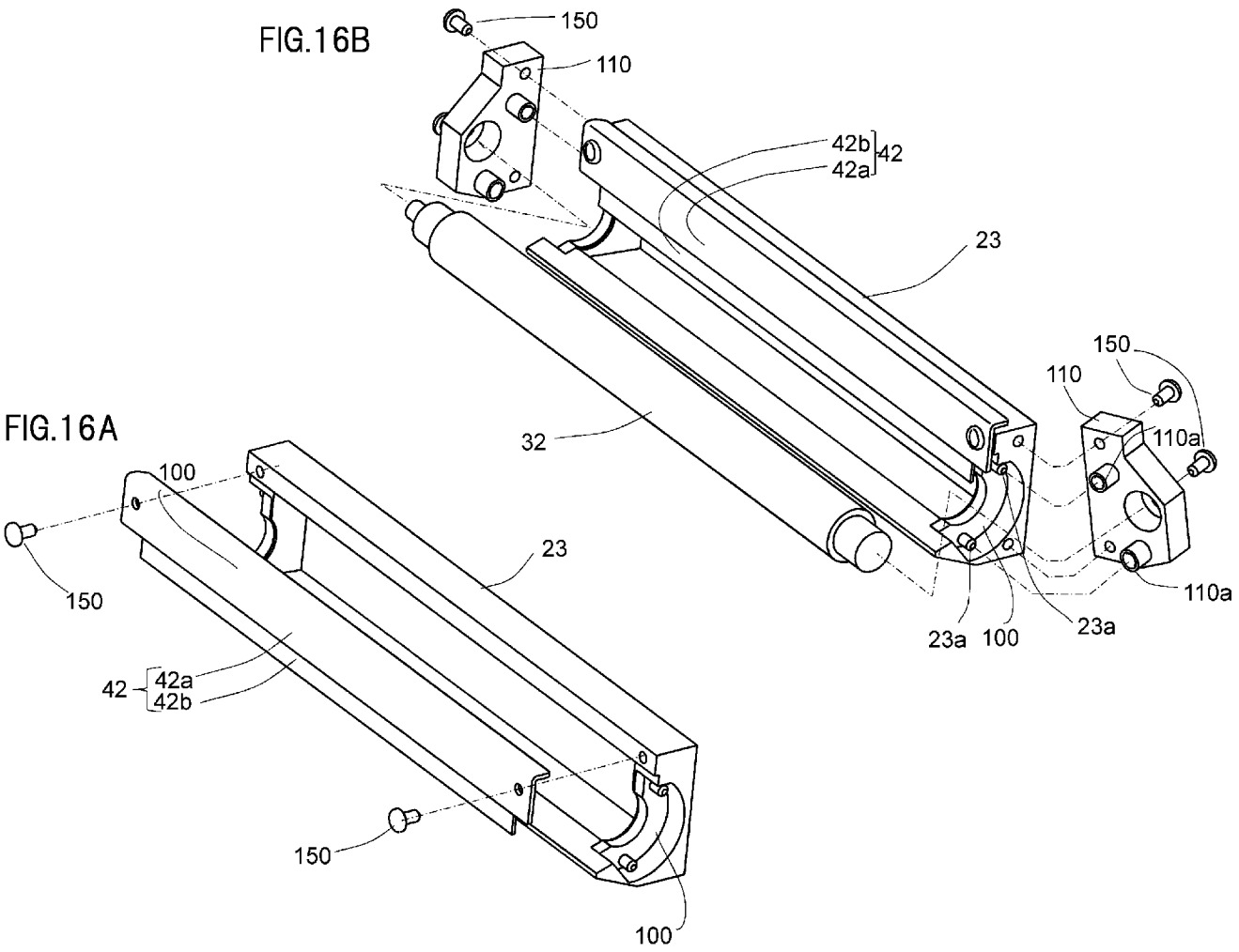
FIGS. 16A and 16B are diagrams illustrating an assembly configuration of a developing unit according to an example.
Figure 22A:
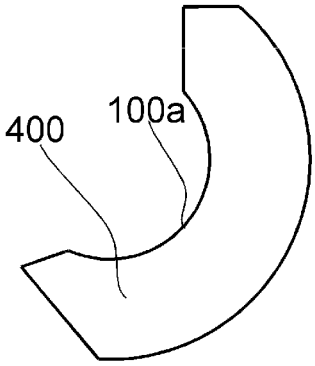
FIGS. 22A to 22C are diagrams illustrating configurations of a seal member and a developer container according to a conventional example.
Figure 22B:
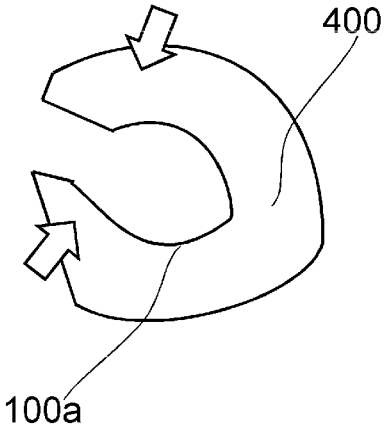
Figure 22C:
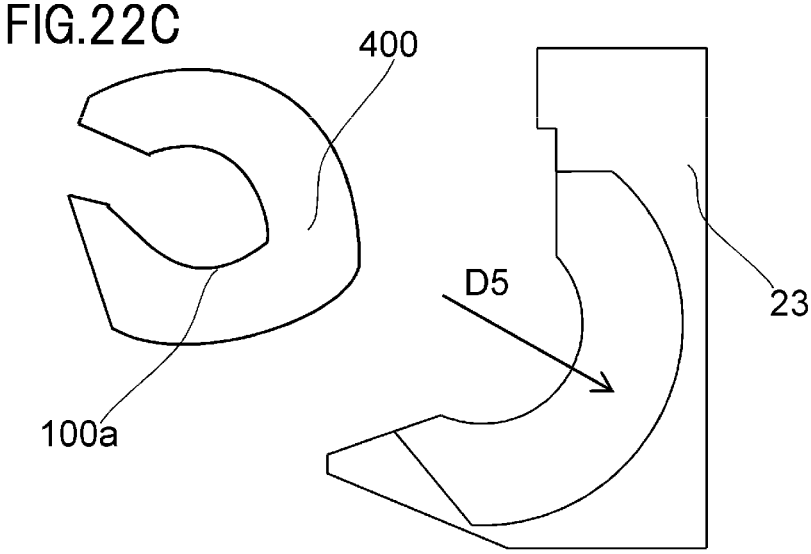

An eighth example of the present invention will now be described mainly with reference to FIGS. 13A, 13A, 14A to 14C, 16A, 16B, and 22A to 22C. FIG. 13A is a schematic perspective view illustrating a state after assembling a seal member 100G to the developer container 23. FIG. 13B is a schematic perspective view illustrating a state before assembling the seal member 100G to the developer container 23. FIG. 14A is a schematic side view illustrating configurations of the seal member 100G and the developer container 23. FIG. 14B is a schematic sectional view illustrating a state before assembling the seal member 100G at a section depicted by a dot chain line H in FIG. 14A. FIG. 14C is a schematic sectional view illustrating a state after assembling the developing roller 32 at a section depicted by the dot chain line H in FIG. 14A. FIG. 16A is a schematic perspective view illustrating a state when assembling the developing blade 42 after assembling the seal member 100G. FIG. 16B is a schematic perspective view illustrating a state when assembling a developing roller supporting member 110 after assembling the developing blade 42. FIGS. 22A to 22C are schematic side views illustrating a state when assembling a conventional seal member 400 made of an elastic body to a developer container. FIG. 22A is a side view of the seal member 400. FIG. 22B is a side view when deforming the seal member 400. FIG. 22C is a side view illustrating a state when assembling the deformed seal member 400 to the developer container 23.

A feature of the eighth example is in an assembly configuration of the seal member 100G and the developer container 23. A configuration of the seal member 100G itself is similar to those of the first to seventh embodiments described above. The developer container 23 according to the present example is configured such that the seal member 100G that is a separate body is attached to the developer container 23 instead of having the seal member 100G integrally molded with the developer container 23. In the eighth example, components in common with those of the examples described above are assigned same reference characters and redundant descriptions thereof will be omitted. Matters not described in the eighth example are similar to those of the examples described above.

As shown in FIGS. 13A and 13B, the seal member 100G is provided with an engaging portion 103 and an engaged portion 23*a* corresponding thereto is provided on the developer container 23. In this case, the engaged portion 23*a* is created in a boss shape that extends in a longitudinal direction (direction D1) while the engaging portion 103 is created in a hole shape that opens in the longitudinal direction (direction D1). To assemble the seal member 100G to the developer container 23, the seal member 100G is assembled to the developer container 23 in the longitudinal direction (direction D1). In addition, two engaging portions 103 engage so as to restrict movement in a direction intersecting the longitudinal direction (direction D1), one engaging portion 103 with a round through-hole for positioning and the other engaging portion 103 with a round through-hole for rotation prevention.

Figure 19:
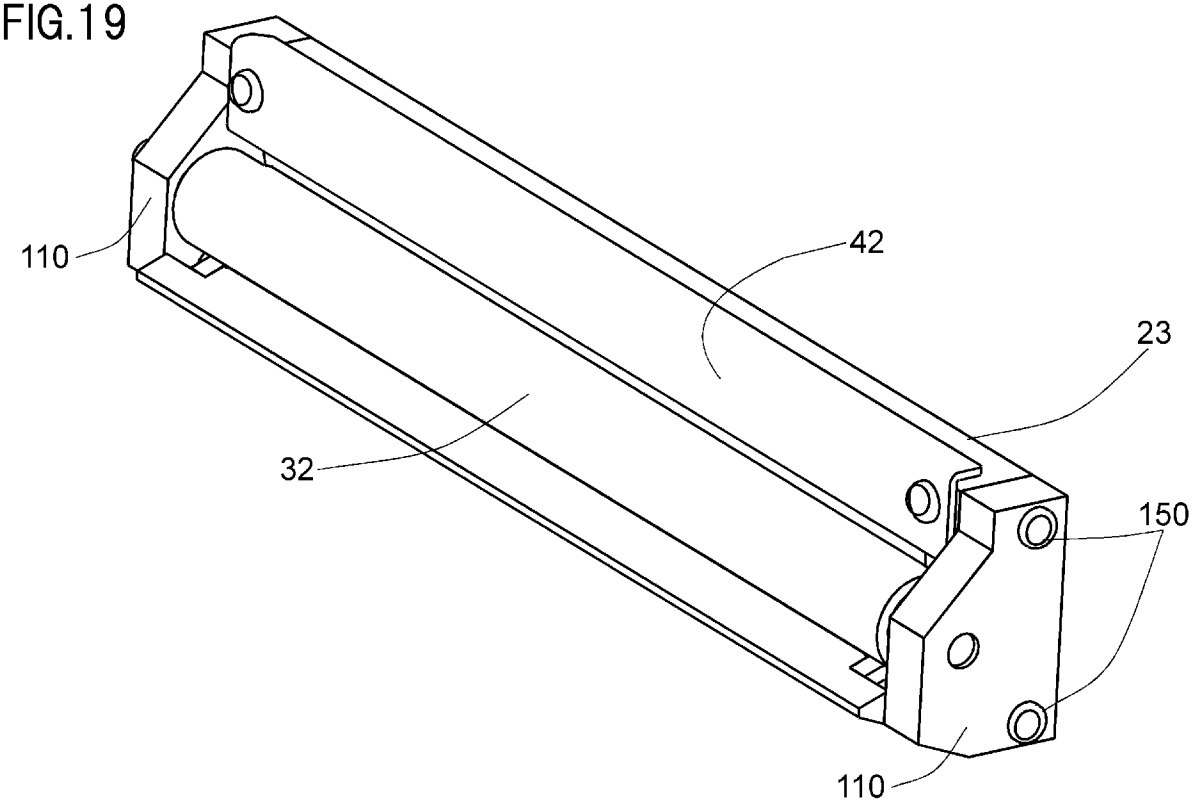
FIG. 19 is a diagram illustrating a configuration of a developing unit according to an example.

As shown in FIGS. 13A and 13B, after assembling the seal member 100G, the developing blade 42 is assembled as shown in FIG. 16A. In addition, in order to support and hold the developing roller 32 at a prescribed position with respect to the developer container 23 as shown in FIG. 16B, the developing roller supporting member 110 is assembled to both ends of the developer container 23 in the longitudinal direction (direction D1) (FIG. 19).

Next, seal configurations between the seal member 100G and the developing roller 32 and between the seal member 100G and the developer container 23 will be described with reference to FIG. 14C. In this case, as shown in FIG. 14C, with the seal member 100G, a developing roller seal portion 100*a* comes into contact with the developing roller 32 in a region enclosed by a dot chain line 300 to implement sealing so that the developer does not leak to the outside from between the seal member 100G and the developing roller 32. In addition, the present example adopts a configuration in which an external dimension of the seal member 100G is larger with respect to a dimension of a mounting space for the seal member 100G in the developer container 23 in a direction D5 that is perpendicular to the longitudinal direction (the direction D1). In other words, a configuration is adopted in which the seal member 100G and a fitting portion of the developer container 23 are fitted by a press-fitting relationship. Accordingly, a seal is formed in a portion (indicated by a dashed line in FIG. 14A) enclosed by a double dot chain line 301 between the seal member 100G and the developer container 23 in FIG. 14C.

By using the relational configuration of the seal member 100G and the developer container 23 described above, the following effects are obtained. Specifically, movement of the seal member 100G in the direction D5 that intersects the direction D1 can be restricted. Accordingly, even the seal member 100G that is made of a soft and readily deformable elastic body can be assembled to the developer container 23 at a prescribed position and can restrict the movement of the seal member 100G in the direction D5 with respect to the developer container 23 even when the developing roller 32 is rotating.

The conventional seal member 400 having elasticity such as that shown in FIGS. 22A to 22C cannot be assembled to the developer container 23 in the direction D5 unless the seal member 400 is deformed and may exhibit difficulty in assembling. On the other hand, with the configuration described in the present example, the seal member 100G can be assembled to the developer container 23 without requiring such deformation of the seal member 100G (FIG. 1).

Moreover, a soft elastomer resin may constitute a material of the seal member 100G according to the present example so as to enable the seal member 100G to come into closer contact with the developer container 23 and the developing roller 32. In addition, the relationship between the engaging portion 103 and the engaged portion 23*a* need only be a mutually concave-convex relationship and bottomed holes may be used instead of through-holes as in the case of the present example.

Ninth Example

Figure 15A:
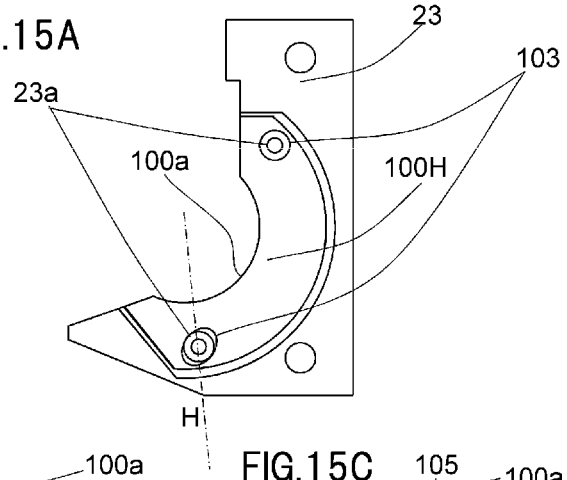
FIGS. 15A to 15E are diagrams illustrating a configuration of a seal member according to a ninth example.
Figure 15B:
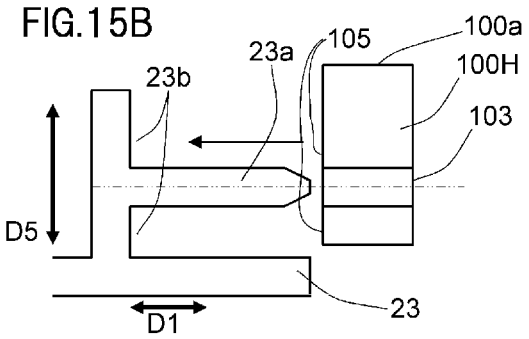
Figure 15C:
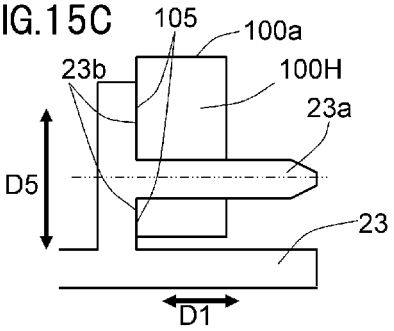
Figure 15D:
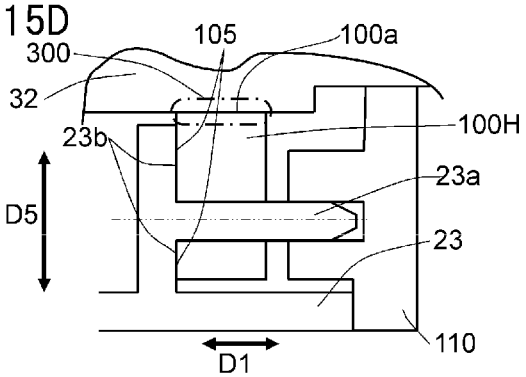
Figure 15E:
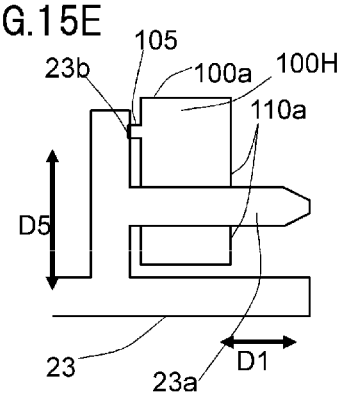

A ninth example of the present invention will now be described mainly with reference to FIGS. 15A to 15E. FIG. 15A is a schematic side view illustrating configurations of a seal member 100H and the developer container 23. FIGS. 15B to 15E are schematic sectional views showing a section at a dot chain line H in FIG. 15A, in which FIG. 15B is a diagram showing a state before assembly of the seal member 100H, FIGS. 15C and 15E are diagrams showing a state after assembly of the seal member 100H, and FIG. 15D is a diagram showing a state after assembly of the developing roller 32.

A feature of the ninth example is in an assembly configuration of the seal member 100H and the developer container 23 and in a configuration of the seal member 100H. A basic configuration of the seal member 100H or, in other words, a configuration related to seal performance between the seal member 100H and the elastic member 42*b* is similar to those in the first to seventh examples described earlier and a feature is in a configuration related to seal performance between the seal member 100H and the developer container 23. The developer container 23 according to the present example is configured such that the seal member 100H that is a separate body is attached to the developer container 23 instead of having the seal member 100H integrally molded with the developer container 23. In the ninth example, components in common with those of the examples described above are assigned same reference characters and redundant descriptions thereof will be omitted. Matters not described in the ninth example are similar to those of the examples described above.

As shown in FIGS. 15A to 15E, the seal member 100H is assembled to the developer container 23 by being moved in a rotational axis direction (longitudinal direction) D1 in a similar manner to the eighth example. As shown in FIG. 15C, the seal member 100H according to the present example is assembled along the engaged portion 23*a* until colliding with a wall 23*b* that opposes the seal member 100H in the direction D1 in the developer container 23. At this point, aside surface seal portion 105 (a fourth seal portion) of the seal member 100H that abuts the wall 23*b* forms a seal between the developer container 23 and the seal member 100H. Subsequently, as shown in FIG. 15D, the developing roller supporting member 110 is assembled to the developer container 23 so as to support both ends of the developing roller 32.

Next, seal configurations between the seal member 100H and the developing roller 32 and between the seal member 100H and the developer container 23 will be described with reference to FIG. 15D. The seal member 100H implements sealing so that the developer does not leak to the outside from between the seal member 100H and the developing roller 32 by having the developing roller seal portion 100*a* come into contact with the developing roller 32 in a region enclosed by a dot chain line 300. In addition, the side surface seal portion 105 collides with the wall 23*b* to implement sealing that prevents the developer from leaking out from inside the toner supply chamber 28.

By using the relational configuration of the side surface seal portion 105 and the wall 23*b* described above, the following effect is obtained. Specifically, in a case of a configuration in which, when assembling the seal member 100H to the developer container 23 in the direction D1, the seal member 100G is fitted to the developer container 23 by press-fitting in the direction D5 as in the example shown in FIGS. 14A to 14C, at least a resistance force against press-fitting corresponding to a sliding length in the direction D1 is created. Therefore, a force equal to or greater than a press-fitting force is required during assembly. On the other hand, in the present example, such a force due to resistance to press-fitting is not created during assembly. Therefore, according to the present example, seal performance can be secured and, at the same time, an improvement in assemblability can be achieved.

Moreover, as a configuration of the side surface seal portion 105, the side surface seal portion 105 may be formed by an entire side surface of the seal member 100H as shown in FIGS. 15B to 15D or the side surface seal portion 105 may be formed by a rib-shaped protrusion provided on the side surface of the seal member 100H as shown in FIG. 15E.

Tenth Example

Figure 17:
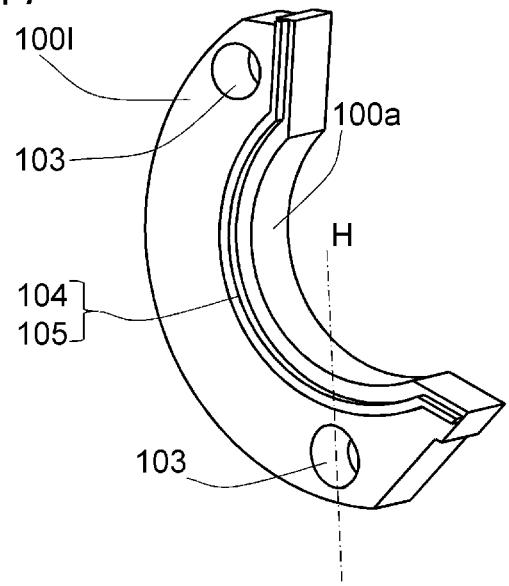
FIG. 17 is a diagram illustrating a configuration of a seal member according to a tenth example.
Figure 18A:
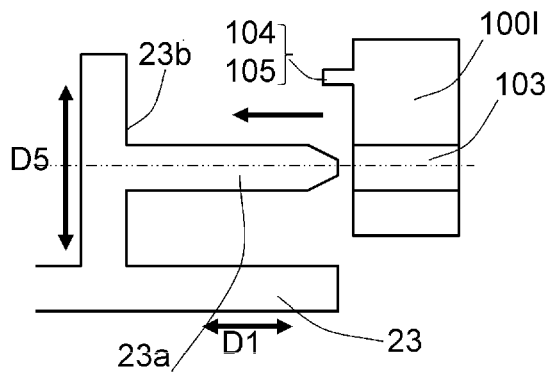
FIGS. 18A to 18C are diagrams illustrating a configuration of a seal member according to the tenth example.
Figure 18B:
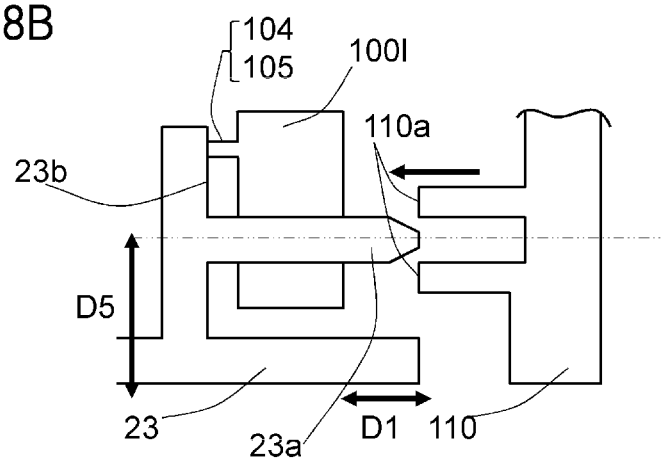
Figure 18C:
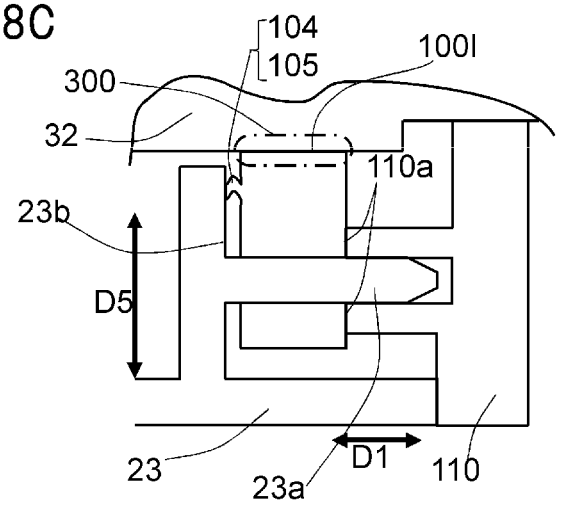

A tenth example of the present invention will now be described mainly with reference to FIGS. 17, 18A to 18C, and 19. FIG. 17 is an explanatory perspective view of a seal member 100I. FIGS. 18A to 18C are schematic sectional views showing a section at a dot chain line H in FIGS. 15A to 15E. FIG. 18A is a diagram showing a state before assembling the seal member 100I to the developer container 23. FIG. 18B is a diagram showing a state before assembling the developing roller supporting member 110 to the developer container 23 after assembling the seal member 100I to the developer container 23. FIG. 18C is a diagram showing a state after assembling the developing roller supporting member 110 to the developer container 23. FIG. 19 is a schematic perspective view showing a state after assembling the seal member 100I and the developing roller supporting member 110 to the developer container 23.

A feature of the tenth example is in a configuration for maintaining seal performance between the wall 23*b* and the seal member 100I during assembly of the developer container 23 and the seal member 100I. While a basic configuration of the seal member 100I according to the present example or, in other words, a configuration related to seal performance between the seal member 100I and the elastic member 42*b* is similar to those in the first to seventh examples described earlier, the seal member 100I is manufactured separately from the developer container 23 and then attached to the developer container 23. In the tenth example, components in common with those of the examples described above are assigned same reference characters and redundant descriptions thereof will be omitted. Matters not described in the tenth example are similar to those of the examples described above.

In the tenth example, after the seal member 100I is attached to the developer container 23 in a similar manner to the eighth example as shown in FIGS. 13A and 13B, the developing blade 42 is attached to the developer container 23 as shown in FIG. 18A. In addition, in order to support and hold the developing roller 32 at a prescribed position with respect to the developer container 23, as shown in FIG. 18B, the developing roller supporting member 110 is assembled so that an engaging portion thereof is inserted to the engaged portion 23*a* of the developer container 23 in the direction D1 (the longitudinal direction) (FIG. 19). As shown in FIG. 18C, with the seal member 100I, the developing roller seal portion 100*a* comes into contact with the developing roller 32 in a region enclosed by a dot chain line 300 to implement sealing so that the developer does not leak to the outside from inside containers such as the toner supply chamber 28. In addition, the side surface seal portion 105 collides with the wall 23*b* to implement sealing that prevents the developer from leaking to the outside from inside containers such as the toner supply chamber 28.

In the tenth example, the developing roller supporting member 110 includes a pressing portion 110*a* that presses the seal member 100I in the direction D1. As shown in FIG. 17, the seal member 100I has a deforming portion 104 that is pressed by the developing roller supporting member 110 and deforms due to a reaction force received from the wall 23*b* of the developer container 23. In this case, the deforming portion 104 doubles as the side surface seal portion 105 that is a seal portion with the developer container 23 and is constituted by a rib-shaped protrusion that protrudes from a side surface of the seal member 100I in a direction opposing the wall 23*b* (the direction D1). In addition, as shown in FIG. 19, the developing roller supporting member 110 is assembled to both ends of the developer container 23 and subsequently fixed to the developer container 23 by screws 150.

In the tenth example, the developing roller supporting member 110 has a function of supporting the developing roller 32 as well as a function of pressing the seal member 100I against the developer container 23 to increase adhesiveness between the seal member 100I and the developer container 23. Alternatively, a configuration may be adopted which divides the developing roller supporting member 110 in accordance with the two functions so that the functions are respectively performed by separate members. In other words, while the present example adopts a configuration in which a tip surface of an engaging portion (a cylindrical protrusion) of the developing roller supporting member 110 that engages the engaged portion 23*a* of the developer container 23 functions as the pressing portion 110*a*, a component that presses the seal member can be provided separately from the engaging portion.

By using the developing roller supporting member 110 provided with the pressing portion 110*a* as described above, the seal member 100I can be held in a state where the side surface seal portion 105 is pressed against the wall 23*b* in the longitudinal direction (the direction D1). In addition, manufacturing tolerances are respectively created in "a width of the seal member 100I" and "a distance of a gap between the wall 23*b* and the pressing portion 110*a*" in the longitudinal direction (the direction D1). These tolerances can be absorbed by compressive deformation of the deforming portion 104 that doubles as the side surface seal portion 105. Moreover, in order to have the deforming portion 104 perform its tolerance absorbing function, shapes and dimensions of respective members are set so that the pressing portion 110*a* crushes the deforming portion 104 without fail. According to the present example, by providing the deforming portion 104, leakage of the developer from between the seal member 100I, the wall 23*b*, and the pressing portion 110*a* in the longitudinal direction (the direction D1) can be prevented and manufacturing precision can be relaxed.

Eleventh Example

Figure 20:
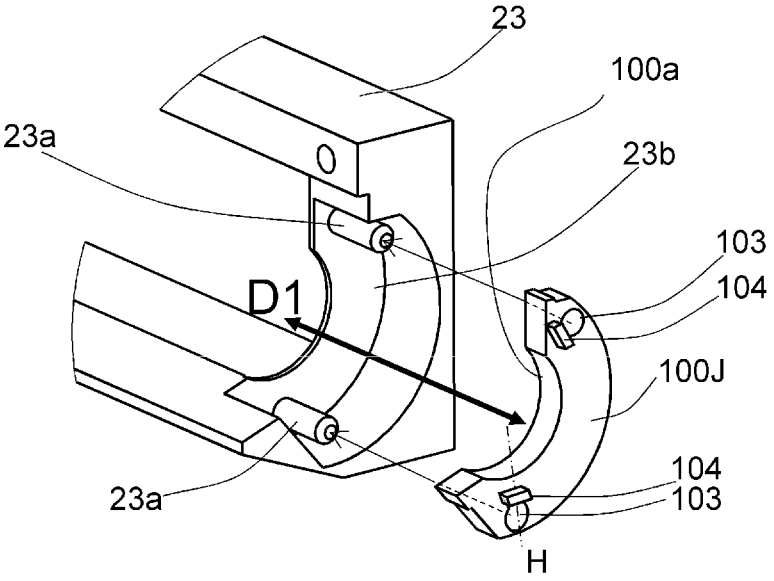
FIG. 20 is a diagram illustrating a configuration of a seal member according to an eleventh example.

An eleventh example of the present invention will now be described mainly with reference to FIGS. 20 and 21A to 21C. FIG. 20 is a schematic perspective view illustrating a state when assembling a seal member 100J to the developer container 23. FIGS. 21A and 21B are schematic sectional views showing a section at a dot chain line H in FIG. 20, in which FIG. 21A is a diagram showing a state before assembly of the seal member 100J to the developer container 23, and FIGS. 21B and 21C are diagrams showing a state after assembly of the seal member 100J to the developer container 23.

A feature of the eleventh example is in a configuration for maintaining seal performance between the wall 23*b* and the seal member 100J during assembly of the developer container 23 and the seal member 100J. While a basic configuration of the seal member 100J according to the present example or, in other words, a configuration related to seal performance between the seal member 100J and the elastic member 42*b* is similar to those in the first to seventh examples described earlier, the seal member 100J is manufactured separately from the developer container 23 and then attached to the developer container 23. In the eleventh example, components in common with those of the examples described above are assigned same reference characters and redundant descriptions thereof will be omitted. Matters not described in the eleventh example are similar to those of the examples described above.

As shown in FIG. 20, the seal member 100J according to the present example is provided with the deforming portion 104. In this case, the deforming portion 104 is provided on a side surface of the seal member 100J on a side of the developing roller supporting member 110 in the longitudinal direction (the direction D1) (FIG. 21A). As shown in FIG. 21B, when the developing roller supporting member 110 for pressing the seal member 100J is assembled, the deforming portion 104 deforms so as to be crushed by the pressing portion 110*a* of the developing roller supporting member 110. At this point, the side surface seal portion 105 on an opposite side to the deforming portion 104 in the direction D1 comes into contact with the wall 23*b* and implements sealing between the seal member 100J and the developer container 23. In addition, with the seal member 100J, the developing roller seal portion 100*a* comes into contact with the developing roller 32 in a region enclosed by a dot chain line 300 to implement sealing so that the developer does not leak to the outside from inside containers.

In this case, as shown in FIG. 21B, the deforming portion 104 and the side surface seal portion 105 are arranged so that positions thereof overlap with each other in the direction D1. In addition, as another example, as shown in FIG. 21C, a configuration may be adopted in which the deforming portion 104 is provided on a side wall of the seal member 100J on a side of the wall 23*b* and the deforming portion 104 and the side surface seal portion 105 are arranged so as to overlap with each other in the direction D1. According to this arrangement, an elastic repulsive force of the deforming portion 104 created by a compressive deformation of the deforming portion 104 due to pressing by the pressing portion 110*a* acts directly (linearly) on the side surface seal portion 105 or, in other words, a pressing force of the pressing portion 110*a* can be transmitted to the side surface seal portion 105 in a straight line. Accordingly, the side surface seal portion 105 can be pressed against the wall 23*b* in an efficient manner and seal performance can be improved.

In the example shown in FIG. 21B, the deforming portion 104 and the side surface seal portion 105 are separated as different components. Accordingly, since the side surface seal portion 105 can press the developer container 23 as a surface and implement sealing without deforming, seal performance between the seal member 100J and the developer container 23 is improved. On the other hand, when the deforming portion 104 is provided on the side of the wall 23*b* (FIG. 21C), a position of the developing roller seal portion 100*a* with respect to the developer container 23 in the direction D1 changes by an amount corresponding to a variation in an amount of deformation of the deforming portion 104. However, when the deforming portion 104 is provided on the side of the pressing portion 110*a* (FIG. 21B), the change in position by an amount corresponding to a variation in an amount of deformation of the deforming portion 104 does not occur.

Configurations of the respective examples described above can be mutually combined to the greatest extent feasible. In addition, while the respective examples described above represent applications of the present invention in a seal member of a developing unit, configurations to which the present invention is applicable are not limited to the respective examples described above. For example, the present invention is also applicable to a seal configuration for preventing leakage of waste toner from the waste toner chamber 71*b* in a cleaning unit or, in other words, to a seal member which is provided on the cleaning frame body 71 and which abuts or comes into sliding contact with the cleaning blade 77 or the photosensitive drum 62.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-132126, filed Jun. 30, 2015, which is hereby incorporated by reference herein in its entirety.

The invention claimed is:

1. A seal member, which is used in a unit including a storage container that stores a developer, a rotating body that is provided in an opening of the storage container, and a blade of which a tip portion abuts the rotating body, and which implements sealing so as to prevent the developer from leaking to the outside of the storage container, the seal member comprising:

a first seal portion configured to abut an end portion of the rotating body in an axial direction of a rotational axis of the rotating body so as to seal a gap between the storage container and the end portion of the rotating body; and a second seal portion configured to abut an end portion of the blade in the axial direction so as to seal a gap between the storage container and the end portion of the blade, the second seal portion having a tip contacting portion configured to contact with the tip portion of the blade and a non-tip contacting portion adjacent to the tip contacting portion in a direction perpendicular to the axial direction and configured to contact with a portion of the blade except for the tip portion, the non-tip contacting portion being recessed from the tip contacting portion to form a step between the non-tip contacting portion and the tip contacting portion, wherein the tip contacting portion of the second seal portion includes:

a base portion configured to contact with the storage container;

an abutting portion configured to abut the blade; and a connecting portion which connects the base portion and the abutting portion to each other, and wherein a vacant space, enclosed by the base portion, the abutting portion, and the connecting portion, is formed.

2. The seal member according to claim 1, wherein the tip contacting portion of the second seal portion includes a wall portion which has a smaller thickness in the axial direction than any of the base portion, the abutting portion, and the connecting portion and which is connected to at least any one of the base portion, the abutting portion, and the connecting portion.

3. The seal member according to claim 1, wherein the tip contacting portion of the second seal portion includes a second connecting portion which connects the base portion and the abutting portion to each other, wherein the vacant space is enclosed by the base portion, the abutting portion, the connecting portion, and the second connecting portion.

4. The seal member according to claim 1, the abutting portion of the second seal portion is configured to deform in a direction approaching the base portion of the second seal portion by being pressed by the tip portion of the blade when the seal member is attached to the storage container, and the blade and the rotating body are attached to the storage container.

5. The seal member according to claim 1, wherein the seal member is formed of an elastomer resin and is integrally molded with the storage container.

6. The seal member according to claim 1, wherein the seal member is configured of a plurality of split portions and the seal member includes, among the plurality of portions, a plurality of adhesion portions which are bonded to the storage container and a non-adhesion portion which is assembled to the storage container by being sandwiched using an elastic force by at least two of the adhesion portions.

7. The seal member according to claim 1, further comprising a fourth seal portion which abuts the storage container in the axial direction.

8. The seal member according to claim 7, wherein the fourth seal portion is a side surface which opposes the storage container in the axial direction.

9. The seal member according to claim 7, wherein the fourth seal portion is a protrusion which protrudes in the axial direction.

10. The seal member according to claim 1, wherein the non-tip contacting portion of the second seal portion has no vacant space.

11. The seal member according to claim 1, wherein the first seal portion has no vacant space.

12. A unit which is attachable to and detachable from an apparatus main body of an image forming apparatus, the unit comprising:

a storage container that stores a developer;

a developer bearing member configured to bear the developer, the developer bearing member being rotatably supported by the storage container;

a blade of which a tip portion abuts the developer bearing member, an opposite portion of the blade opposite to the tip portion in a direction perpendicular to a longitudinal direction of the blade being fixed to the storage container; and a seal member including a first seal portion which abuts an end portion of the developer bearing member in an axial direction of a rotational axis of the developer bearing member so as to seal a gap between the storage container and the end portion of the developer bearing member, and a second seal portion which abuts an end portion of the blade in the axial direction so as to seal a gap between the storage container and the end portion of the blade, the second seal portion having a tip contacting portion configured to contact with the tip portion of the blade and a non-tip contacting portion adjacent to the tip contacting portion in a direction perpendicular to the axial direction and configured to contact with a portion of the blade except for the tip portion, the non-tip contacting portion being recessed from the tip contacting portion to form a step between the non-tip contacting portion and the tip contacting portion, wherein the tip contacting portion of the second seal portion includes:

a base portion which contacts with the storage container;

an abutting portion which abuts the blade;

a connecting portion which connects the base portion and the abutting portion to each other, wherein a vacant space, enclosed by the base portion, the abutting portion, and the connecting portion, is formed in a state that the developer bearing member and the blade are not attached to the storage container, and the abutting portion of the second seal portion deforms in a direction approaching the base portion of the second seal portion by being pressed by the tip portion of the blade.

13. The unit according to claim 12, wherein a wall portion which has a smaller thickness in the axial direction than any of the base portion, the abutting portion, and the connecting portion, and which is connected to at least any one of the base portion, the abutting portion, and the connecting portion.

14. The unit according to claim 12, wherein the tip contacting portion of the second seal portion includes a second connecting portion which connects the base portion and the abutting portion to each other, wherein the vacant space is enclosed by the base portion, the abutting portion, the connecting portion, and the second connecting portion.

15. The unit according to claim 12, further comprising a second seal member which seals a gap between the second seal portion and the tip portion of the blade.

16. The unit according to claim 12, wherein the non-tip contacting portion of the second seal portion has no vacant space.

17. The unit according to claim 12, wherein the first seal portion has no vacant space.

18. The unit according to claim 12, wherein the seal member is formed of an elastomer resin and is integrally molded with the storage container.

* * * * *